US009746221B2

(12) United States Patent
Yoshikawa et al.

(10) Patent No.: US 9,746,221 B2
(45) Date of Patent: Aug. 29, 2017

(54) DEFROST SYSTEM FOR REFRIGERATION APPARATUS, AND COOLING UNIT

(71) Applicant: MAYEKAWA MFG. CO., LTD., Tokyo (JP)

(72) Inventors: Choiku Yoshikawa, Tokyo (JP); Toshio Kutsuna, Tokyo (JP); Mugabi Nelson, Tokyo (JP); Daiki Kayashima, Tokyo (JP)

(73) Assignee: MAYEKAWA MFG. CO., LTD., Tokyo (JP)

( * ) Notice: Subject to any disclaimer, the term of this patent is extended or adjusted under 35 U.S.C. 154(b) by 100 days.

(21) Appl. No.: 14/903,870

(22) PCT Filed: Nov. 25, 2014

(86) PCT No.: PCT/JP2014/081043
§ 371 (c)(1),
(2) Date: Jan. 8, 2016

(87) PCT Pub. No.: WO2015/093234
PCT Pub. Date: Jun. 25, 2015

(65) Prior Publication Data

US 2016/0178258 A1 Jun. 23, 2016

(30) Foreign Application Priority Data

Dec. 17, 2013 (JP) ..... 2013-259751

(51) Int. Cl.
*F25B 47/02* (2006.01)
*F25D 17/02* (2006.01)
(Continued)

(52) U.S. Cl.
CPC ..... *F25B 47/02* (2013.01); *F25B 1/10* (2013.01); *F25B 7/00* (2013.01); *F25B 9/00* (2013.01);
(Continued)

(58) Field of Classification Search
USPC ..... 62/152, 156
See application file for complete search history.

(56) References Cited

U.S. PATENT DOCUMENTS 3,084,519 A * 4/1963 Hanson ..... F25D 17/062 62/155
3,228,204 A * 1/1966 Matthies ..... F25D 21/02 62/140
(Continued)

FOREIGN PATENT DOCUMENTS

AT 29817062 U1 * 4/1999 ..... A47F 3/0482
CA 2662986 A1 * 10/2009 ..... C09K 5/041
(Continued)

OTHER PUBLICATIONS

DE2503303 A1 Machine Translation English Retrieved Jun. 2017.*
(Continued)

*Primary Examiner* — Len Tran
*Assistant Examiner* — Jenna M Hopkins
(74) *Attorney, Agent, or Firm* — Rossi, Kimms & McDowell LLP

(57) ABSTRACT

A defrost system includes: a cooling device in a freezer, and includes a casing, a heat exchanger pipe with a difference in elevation in the casing, and a drain receiver unit below the heat exchanger pipe; a refrigerating device to cool and liquefy $CO_2$ refrigerant; and a refrigerant circuit for permitting the cooled and liquefied $CO_2$ refrigerant to circulate to the heat exchanger pipe. The defrost system includes a bypass pipe of the heat exchanger pipe to form a $CO_2$ circulation path; an on-off valve in the heat exchanger pipe to be closed during defrosting so that the $CO_2$ circulation path is a closed circuit; a pressure adjusting unit for adjusting pressure of the $CO_2$ refrigerant during defrosting; and a brine circuit as a first heating medium, in which the defrost
(Continued)

system permits the $CO_2$ refrigerant to naturally circulate in the closed circuit during defrosting by a thermosiphon effect.

15 Claims, 11 Drawing Sheets

(51) Int. Cl.

| | |
|---|---|
| ***F25B 1/10*** | (2006.01) |
| ***F25B 7/00*** | (2006.01) |
| ***F25D 21/10*** | (2006.01) |
| ***F25B 9/00*** | (2006.01) |
| ***F25B 41/00*** | (2006.01) |
| ***F25B 41/04*** | (2006.01) |
| ***F25B 49/02*** | (2006.01) |
| ***F25D 21/12*** | (2006.01) |
| ***F25D 21/14*** | (2006.01) |
| *F25B 25/00* | (2006.01) |
| *F25B 23/00* | (2006.01) |

(52) U.S. Cl.

CPC ..... *F25B 9/008* (2013.01); *F25B 41/00* (2013.01); *F25B 41/04* (2013.01); *F25B 49/02* (2013.01); *F25D 17/02* (2013.01); *F25D 21/10* (2013.01); *F25D 21/12* (2013.01); *F25D 21/14* (2013.01); *F25B 23/006* (2013.01); *F25B 25/00* (2013.01); *F25B 2339/047* (2013.01); *F25B 2347/022* (2013.01); *F25B 2400/072* (2013.01); *F25B 2400/13* (2013.01)

(56) References Cited

U.S. PATENT DOCUMENTS

| | | | | |
|---|---|---|---|---|
| 6,170,270 | B1 | 1/2001 | Arshansky et al. | |
| 7,992,397 | B2 * | 8/2011 | Nemoto | F25B 9/002 62/114 |
| 2006/0266058 | A1 * | 11/2006 | Nemoto | F25B 9/002 62/183 |
| 2007/0234753 | A1 * | 10/2007 | Nemoto | F25B 25/005 62/335 |
| 2012/0055182 | A1 * | 3/2012 | Dub | F24F 3/1417 62/81 |
| 2012/0055185 | A1 | 3/2012 | Luo et al. | |
| 2013/0098078 | A1 * | 4/2013 | Contreras Lafaire | F25D 21/06 62/82 |
| 2014/0260361 | A1 * | 9/2014 | Rodier | F25D 21/12 62/80 |
| 2014/0352343 | A1 * | 12/2014 | Hinde | F25B 1/10 62/277 |
| 2015/0204589 | A1 * | 7/2015 | Liu | F25B 1/10 62/80 |

FOREIGN PATENT DOCUMENTS

| | | | | |
|---|---|---|---|---|
| DE | 2503303 | A1 * | 8/1975 | F25D 21/12 |
| DE | 29817062 | U1 | 4/1999 | |
| EP | 1630495 | A1 | 3/2006 | |
| JP | 5244468 | U | 3/1977 | |
| JP | 52131652 | U | 10/1977 | |
| JP | 2001027473 | A | 1/2001 | |
| JP | 2003021365 | A | 1/2003 | |
| JP | 2003329334 | A | 11/2003 | |
| JP | 2004170007 | A | 6/2004 | |
| JP | 4197562 | B2 | 10/2008 | |
| JP | 2010181093 | A * | 8/2010 | |
| JP | 2012072981 | A | 4/2012 | |
| JP | 2013124812 | A * | 6/2013 | |
| JP | 2013160427 | A | 8/2013 | |
| JP | 5316973 | B2 * | 10/2013 | |
| KR | 2019940008247 | U | 4/1994 | |
| KR | 20110021128 | A * | 3/2011 | F25D 21/14 |
| WO | WO 2006049355 | A1 * | 5/2006 | F25D 21/12 |
| WO | 2008112554 | A1 | 9/2008 | |
| WO | 2009034300 | A1 | 3/2009 | |

OTHER PUBLICATIONS

DE29817062 U1 Machine Translation English Retrieved Jun. 2017.*

JP 2010-181093A Machine Translation English Retrieved Jun. 2017.*

JP 2013—124812A Machine Translation Engish Retrieved Jun. 2017.*

JP5316973 B2 Machine Translation English—Retrieved May 2017.*

STIC NPL and Patent Search Results—Retrieved Jun. 2017.*

KR20110021128A Machine Translation English—Retrieved May 2017.*

International Search Report issued in PCT/JP2014/081043 dated Feb. 24, 2015. English translation provided.

Written Opinion issued in PCT/JP2014/081043 dated Feb. 24, 2015.

International Search Report issued in PCT/JP2014/081042 dated Feb. 24, 2015. English translation provided.

Written Opinion issued in PCT/JP2014/081042 dated Feb. 24, 2015.

International Search Report issued in PCT/JP2014/081044, mailed Feb. 24, 2015. English translation provided.

Written Opinion issued in PCT/JP2014/081044, mailed Feb. 24, 2015.

International Preliminary Report on Patentability issued in Intl. Appln. No. PCT/JP2014/081042 mailed Jun. 21, 2016. English translation provided.

International Preliminary Report on Patentability issued in Intl. Appln. No. PCT/JP2014/081043 mailed Jun. 21, 2016. English translation provided.

International Preliminary Report on Patentability issued in Intl. Appln. No. PCT/JP2014/081044 mailed Jun. 21, 2016. English translation provided.

Extended European Search Report issued in European Appln. No. 14873060.9, mailed Oct. 28, 2016.

Extended European Search Report issued in European Appln. No. 14871996.6, mailed Oct. 28, 2016.

Office Action issued in Korean Appln. No. 10-2016-7019058 mailed Apr. 10, 2017. English translation provided.

Office Action issued in Korean Appln. No. 10-2016-7019012 mailed Apr. 10, 2017. English translation provided.

Office Action issued in Korean Appln. No. 10-2016-7018741 mailed Apr. 10, 2017. English translation provided.

* cited by examiner

X: HEADER SURFACE
Y: LOWEST 2 OR 3 STAGES FROM LOWER PORTION OF HEADER PART
Z: FREEZER INNER AIR

: DISCHARGE WATER INCREASED AMOUNT
P: $CO_2$ PRESSURE IN COOLING DEVICE [MPa]

DEFROST SYSTEM FOR REFRIGERATION APPARATUS, AND COOLING UNIT

TECHNICAL FIELD

The present disclosure relates to a defrost system applied to a refrigeration apparatus which cools the inside of a freezer by permitting $CO_2$ refrigerant to circulate in a cooling device disposed in the freezer, for removing frost attached to a heat exchanger pipe disposed in the cooling device, and relates to a cooling unit that can be applied to the defrost system.

BACKGROUND

To prevent the ozone layer depletion, global warming, and the like, natural refrigerant such as $NH_3$ or $CO_2$ has been reviewed as refrigerant in a refrigeration apparatus used for room air conditioning and refrigerating food products. Thus, refrigeration apparatuses using $NH_3$, with high cooling performance and toxicity, as a primary refrigerant and using $CO_2$, with no toxicity or smell, as a secondary refrigerant have been widely used.

In the refrigeration apparatus, a primary refrigerant circuit and a secondary refrigerant circuit are connected to each other through a cascade condenser. Heat exchange between the $NH_3$ refrigerant and the $CO_2$ refrigerant takes place in the cascade condenser. The $CO_2$ refrigerant cooled and liquefied with the $NH_3$ refrigerant is sent to a cooling device disposed in the freezer, and cools air in the freezer through a heat transmitting pipe disposed in the cooling device. The $CO_2$ refrigerant partially vaporized therein returns to the cascade condenser through the secondary refrigerant circuit, to be cooled and liquefied again in the cascade condenser.

Frost attaches to a heat exchanger pipe disposed in the cooling device while the refrigeration apparatus is under operation, and thus the heat transmission efficiency degrades. Thus, the operation of the refrigeration apparatus needs to be periodically stopped, to perform defrosting.

Conventional defrosting methods for the heat exchanger pipe disposed in the cooling device include a method of spraying water onto the heat exchanger pipe, a method of heating the heat exchanger pipe with an electric heater, and the like. The defrosting by spraying water ends up producing a new source of frost, and the heating by the electric heater is against an attempt to save power because valuable power is wasted. In particular, the defrosting by spraying water requires a tank with a large capacity and water supply and discharge pipes with a large diameter, and thus increases plant construction cost.

Patent Documents 1 and 2 disclose a defrost system for the refrigeration apparatus described above. A defrost system disclosed in Patent Document 1 is provided with a heat exchanger unit which vaporizes the $CO_2$ refrigerant with heat produced in the $NH_3$ refrigerant, and achieves the defrosting by permitting $CO_2$ hot gas generated in the heat exchanger unit to circulate in the heat exchanger pipe in the cooling device.

A defrost system disclosed in Patent Document 2 is provided with a heat exchanger unit which heats the $CO_2$ refrigerant with cooling water that has absorbed exhaust heat from the $NH_3$ refrigerant, and achieves the defrosting by permitting the heated $CO_2$ refrigerant to circulate in the heat exchanger pipe in the cooling device.

Patent Document 3 discloses a method of providing a heating tube in the cooling device separately and independently from a cooling tube, and melts and removes the frost attached to the cooling tube by permitting warm water or warm brine to flow in the heating tube at the time of a defrosting operation.

CITATION LIST

Patent Literature

Patent Document 1: Japanese Patent Application Laid-open No. 2010-181093
Patent Document 2: Japanese Patent Application Laid-open No. 2013-124812
Patent Document 3: Japanese Patent Application Laid-open No. 2003-329334

SUMMARY

Technical Problem

Each of the defrost systems disclosed in Patent Documents 1 and 2 requires the pipes for the $CO_2$ refrigerant and the $NH_3$ refrigerant in a system different from the cooling system to be constructed at the installation site, and thus might increase the plant construction cost. The heat exchanger unit is separately installed outside the freezer, and thus an extra space for installing the heat exchanger unit is required.

In the defrost system in Patent Document 2, a pressurizing/depressurizing adjustment unit is required to prevent thermal shock (sudden heating/cooling) in the heat exchanger pipe. To prevent the heat exchanger unit, where the cooling water and the $CO_2$ refrigerant exchange heat, from freezing, an operation of discharging the cooling water in the heat exchanger unit needs to be performed after the defrosting operation is terminated. Thus, there is a problem in that, for example, an operation is complicated.

The defrost unit disclosed in Patent Document 3 has a problem in that the heat transmission efficiency is low because the cooling tube is heated from the outside with plate fins and the like.

Furthermore, in a cascade refrigerating device including: a primary refrigerant circuit in which the $NH_3$ refrigerant circulates and a refrigerating cycle component is provided; and a secondary refrigerant circuit in which the $CO_2$ refrigerant circulates and a refrigerating cycle component is disposed, the secondary refrigerant circuit being connected to the primary refrigerant circuit through a cascade condenser, the secondary refrigerant circuit contains $CO_2$ gas with high temperature and high pressure. Thus, the defrosting can be achieved by permitting the $CO_2$ hot gas to circulate in the heat exchanger pipe in the cooling device. However, the cascade refrigerating device has the following problems. Specifically, the device is complicated and involves high cost because selector valves, branch pipes, and the like are provided. Furthermore, a control system is unstable due to high/low temperature heat balance.

The present invention is made in view of the above problems, and an object of the present invention is to achieve reduction in initial cost and running cost required for defrosting a cooling device disposed in a cooling space such as a freezer, and power saving in a refrigeration apparatus using $CO_2$ refrigerant.

Solution to Problem

A defrost system according to at least one embodiment of the present invention is:

(1) a defrost system for a refrigeration apparatus including: a cooling device which is disposed in a freezer, and includes a casing, a heat exchanger pipe with a difference in elevation disposed in the casing, and a drain receiver unit disposed below the heat exchanger pipe; a refrigerating device configured to cool and liquefy $CO_2$ refrigerant; and a refrigerant circuit for permitting the $CO_2$ refrigerant cooled and liquefied in the refrigerating device to circulate to the heat exchanger pipe, the defrost system including:

a bypass pipe connected between an inlet path and an outlet path of the heat exchanger pipe to form a $CO_2$ circulation path including the heat exchanger pipe;

an on-off valve disposed in each of the inlet path and the outlet path of the heat exchanger pipe and configured to be closed at a time of defrosting so that the $CO_2$ circulation path becomes a closed circuit;

a pressure adjusting unit for adjusting pressure of the $CO_2$ refrigerant circulating in the closed circuit at the time of defrosting; and a brine circuit in which brine as a first heating medium circulates and which includes a first lead path disposed adjacent to the heat exchanger pipe in the cooling device and forming a first heat exchanger part for heating the $CO_2$ refrigerant circulating in the heat exchanger pipe, with the brine, in a lower area of the heat exchanger pipe, the defrost system configured to permitting the $CO_2$ refrigerant to naturally circulate in the closed circuit at the time of defrosting by a thermosiphon effect.

In the configuration (1), the on-off valve is closed at the time of defrosting, whereby the closed circuit is formed. The closed circuit is formed of the heat exchanger pipe disposed in the cooling device except for the bypass path. The pressure of the $CO_2$ refrigerant in the closed circuit is adjusted by the pressure adjusting unit so that the $CO_2$ refrigerant has condensing temperature higher than a freezing point (for example, 0° C.) of the water vapor in freezer inner air in the freezer. The $CO_2$ refrigerant is heated and vaporized with the brine in a first heat exchanger part formed in the lower area of the heat exchanger pipe. The $CO_2$ refrigerant has a higher temperature than the freezing point of the water vapor in the freezer inner air in the freezer. Frost in the lower area of the heat exchanger pipe is melted by sensible heat of the vaporized $CO_2$ refrigerant.

$CO_2$ refrigerant gas as a result of vaporization in the closed circuit rises in the closed circuit due to the thermosiphon effect and melts the frost attached to the outer surface of the heat exchanger pipe with its condensation latent heat, in an upper area of the closed circuit. In the upper area of the closed circuit, the $CO_2$ refrigerant emits heat to the frost and liquefies. The liquid $CO_2$ refrigerant as a result of the liquefying falls in the closed circuit with gravity to the first heat exchanger part. The liquid $CO_2$ refrigerant that has fallen to the first heat exchanger part is heated by the brine to be vaporized and thus rises.

As described above, the $CO_2$ refrigerant in the closed circuit melts the frost attached to the outer surface of the heat exchanger pipe while naturally circulating due to the thermosiphon effect.

The "freezer" includes a refrigerator and anything that forms other cooling spaces. The drain receiver unit includes a drain pan, and further includes anything with a function to receive and store drainage.

The inlet path and the outlet path of the heat exchanger pipe are areas of the heat exchanger pipe disposed in the freezer. The areas extend from a range around a partition wall of the casing of the cooling device to the outer side of the casing.

In the conventional defrosting as disclosed in Patent Document 3, the sensible heat of the brine is transmitted to the heat exchanger pipe (outer surface) with thermal conduction from outside through pueto fins, and thus the heat transmission efficiency is low.

In the configuration (1), the frost attached to the outer surface of the heat exchanger pipe is removed from the inner side of the heat exchanger pipe through the pipe wall with the condensation latent heat of the $CO_2$ refrigerant with a condensing temperature higher than the freezing point of the water vapor in the freezer inner air. Thus, the amount of heat transmitted to the frost can be increased.

In the conventional defrosting method, the amount of heat input at an early stage of the defrosting is used for vaporizing the liquid $CO_2$ refrigerant in the entire area of the cooling device, and thus the thermal efficiency is low. In the configuration (1), heat exchange between the closed circuit formed at the time of defrosting and other portions is blocked, whereby the thermal energy in the closed circuit is not emitted outside, and thus the defrosting which can achieve power saving can be performed.

The $CO_2$ refrigerant naturally circulates due to the thermosiphon effect in the closed circuit formed of the heat exchanger pipe and the bypass path at the time of defrosting, whereby the frost attached to the heat exchanger pipe across the entire area of the closed circuit can be melted and no pump power is required for circulating the $CO_2$ refrigerant and thus further power saving can be achieved.

With the condensing temperature of the $CO_2$ refrigerant at the time of defrosting operation kept at the temperature close to the freezing point of the water vapor in the freezer inner air as much as possible, fogging can be prevented, and the pressure of the $CO_2$ refrigerant can be lowered. Thus, the pipes and the valves forming the closed circuit may be designed for lower pressure. Thus, further cost reduction can be achieved The first lead path is not disposed in the upper area of the heat exchanger pipe, whereby the power used for a fan for forming airflow in the cooling device can be reduced. The cooling performance of the cooling device can be improved by additionally providing the heat exchanger pipe in a vacant space in the upper area.

Any heating medium can be used as the heat source for the brine. Such a heating medium includes refrigerant gas with high temperature and high pressure discharged from the compressor forming the refrigerating device, warm discharge water from a factory, a medium that has absorbed heat emitted from a boiler or sensible heat of an oil cooler, and the like.

Thus, extra exhaust heat from a factory can be used as a heat source for heating the brine.

In some embodiments, in the configuration (1), (2) the first lead path is formed only in the lower area of the heat exchanger pipe in the cooling device, and the first heat exchanger part is formed of an entire area of the first lead path led into the cooling device.

In the configuration (2), the first heat exchanger part is formed of the first lead path disposed only in the lower are of the heat exchanger pipe. Thus, the pressure loss of the air flow formed by the fan and the like can be reduced, and the power used for an air flow forming device such as the fan can be reduced.

The heat exchanger pipe can be additionally provided in the upper area of the heat exchanger pipe where the first lead path is not disposed, whereby the cooling performance of the cooling device can be improved.

In some embodiments, in the configuration (1), (3) the first lead path is provided with the difference in elevation in the cooling device and is configured in such a manner that the brine flows from a lower side to an upper side, and a flowrate adjustment valve is disposed at an intermediate position in an upper and lower direction of the first lead path, and the first heat exchanger part is formed at a portion of the first lead path on an upstream side of the flowrate adjustment valve.

In the configuration (3), the flowrate of the brine is reduced by the flowrate adjustment valve to regulate the flowrate of the brine flowing into the upper area, whereby the first heat exchanger part can be formed only in the lower area of the heat exchanger pipe.

Thus, the power saving and low cost defrosting in which the $CO_2$ refrigerant is permitted to naturally circulate in the closed circuit by the thermosiphon effect can be performed in the existing cooling device having a heating tube in which warm brine circulates are disposed across the entire area of the heat exchanger pipe in the upper and lower direction such as the cooling device disclosed in Patent Document 3, only with a simple modification of providing the flowrate adjustment valve to the heat exchanger pipe.

In some embodiments, in any one of the configurations (1) to (3), (4) the pressure adjusting unit includes a pressure adjustment valve disposed in the outlet path of the heat exchanger pipe.

In the configuration (4), the pressure adjusting unit can be simplified and can be provided with a low cost. A part of the $CO_2$ refrigerant returns to the refrigerant circuit through the pressure adjustment valve when the pressure of the $CO_2$ refrigerant in the closed circuit exceeds a set pressure. Thus, the pressure in the closed circuit is maintained at the set pressure.

In some embodiments, in any one of the configurations (1) to (3), (5) the pressure adjusting unit is configured to adjust a temperature of the brine flowing into the first heat exchanger part to adjust the pressure of the $CO_2$ refrigerant circulating in the closed circuit.

In the configuration (4), the $CO_2$ refrigerant in the closed circuit is heated with the brine to increase the pressure of the $CO_2$ refrigerant in the closed circuit.

In the configuration (4), the pressure adjusting unit needs not to be provided for each cooling device, and only a single pressure adjusting unit needs to be provided. Thus, the cost reduction can be achieved, and the pressure in the closed circuit can be easily adjusted with the pressure in the closed circuit adjusted from the outside of the freezer.

In some embodiments, in any one of the configurations (1) to (5), (6) the brine circuit includes a second lead path led to the drain receiver unit.

In the configuration (6), the frost attached to the drain receiver unit can be removed by the heat of the brine at the time of defrosting, with the second lead path led to the drain receiver unit. Thus, a defrosting heater needs not to be additionally provided to the drain pan, whereby the low cost can be achieved.

In some embodiments, the configuration (6)

(7) further includes a flow path switching unit which enables the first lead path and the second lead path to be connected in parallel or connected in series.

In the configuration (6), when the first lead path and the second lead path are connected in series, the flowrate of the brine flowing therein can be increased, whereby a larger amount of the sensible heat can be used. When the first lead path and the second lead path are connected in parallel, the settable range of the flowrate and the temperature of the brine flowing in the circuits can be widened.

In some embodiments, any of the configurations (1) to (7)

(8) further includes a first temperature sensor and a second temperature sensor which are respectively disposed at an inlet and an outlet of the brine circuit and detect a temperature of the brine flowing through the inlet and the outlet.

In the configuration (8), it is determined that the defrosting is almost completed when the difference between the detected values of the two temperature sensors is small. The sensible heating with the brine is employed for heating the frost. Thus, unlike in the case of the latent heating by the $CO_2$ refrigerant, the timing at which the defrosting is terminated can be accurately determined by obtaining the difference between the detected values.

Thus, the excessive heating and the water vapor diffusion in the freezer can be prevented, whereby further power saving can be achieved, and the quality of the food products cooled in the freezer can be improved with a more stable freezer inner temperature.

In some embodiments, in the configuration (1), (9) the refrigerating device includes:

a primary refrigerant circuit in which $NH_3$ refrigerant circulates and a refrigerating cycle component is disposed;

a secondary refrigerant circuit in which the $CO_2$ refrigerant circulates, the secondary refrigerant circuit led to the cooling device, the secondary refrigerant circuit being connected to the primary refrigerant circuit through a cascade condenser; and a liquid $CO_2$ receiver for storing the $CO_2$ refrigerant liquefied in the cascade condenser and a liquid $CO_2$ pump for sending the $CO_2$ refrigerant stored in the liquid $CO_2$ receiver to the cooling device, which are disposed in the secondary refrigerant circuit.

In the configuration (9), the refrigerating device uses natural refrigerants of $NH_3$ and $CO_2$ and thus facilitates an attempt to prevent the ozone layer depletion, global warming, and the like. Furthermore, the refrigerating device uses $NH_3$, with high cooling performance and toxicity, as a primary refrigerant and uses $CO_2$, with no toxicity or smell, as a secondary refrigerant, and thus can be used for room air conditioning and for refrigerating food products and the like.

In some embodiments, in the configuration (1),

(10) the refrigerating device is a $NH_3/CO_2$ cascade refrigerating device including:

a primary refrigerant circuit in which $NH_3$ refrigerant circulates and a refrigerating cycle component is disposed; and a secondary refrigerant circuit in which the $CO_2$ refrigerant circulates and a refrigerating cycle component is disposed, the secondary refrigerant circuit led to the cooling device, the secondary refrigerant circuit being connected to the primary refrigerant circuit through a cascade condenser In the configuration (10), the natural refrigerant is used, whereby an attempt to prevent the ozone layer depletion, global warming, and the like is facilitated. Furthermore, the refrigerating device is the cascade refrigerating device and thus can have high cooling performance, and have higher COP (coefficient of performance).

In some embodiments, the configuration (9) or (10)

(11) further includes a cooling water circuit led to a condenser provided as a part of the refrigerating cycle component disposed in the primary refrigerant circuit, in which the second heating medium is cooling water circulating in the cooling water circuit and heated in the condenser, and the second heat exchanger part includes a heat exchanger part to which the cooling water circuit and the brine circuit are led, the heat exchanger part exchanging heat between the cooling water circulating in the cooling water circuit and heated in the condenser and the brine circulating in the brine circuit.

In the configuration (11), the brine can be heated with the cooling water heated in the condenser, whereby no heating source outside the refrigeration apparatus is required.

The temperature of the cooling water can be lowered with the brine at the time of defrosting, whereby the condensing temperature of the $NH_3$ refrigerant in the refrigerating operation can be lowered, and the COP of the refrigerating device can be improved.

Furthermore, in the exemplary embodiment where the cooling water circuit is disposed between the condenser and the cooling tower, the second heat exchanger part can be disposed in the cooling tower, whereby the installation space of the device used for defrosting can be downsized.

In some embodiments, the configuration (9) or (10)

(12) further includes a cooling water circuit led to a condenser provided as a part of the refrigerating cycle component disposed in the primary refrigerant circuit, in which the second heating medium is cooling water circulating in the cooling water circuit and heated in the condenser, and the second heat exchanger part includes:

a cooling tower for cooling the cooling water circulating in the cooling water circuit by exchanging heat between the cooling water and spray water; and a heating tower for receiving the spray water and exchanging heat between the brine circulating in the brine circuit and the spray water.

In the configuration (12), by integrating the heating tower with the cooling tower, the installation space of the first heat exchanger part can be downsized.

A cooling unit according to at least one embodiment of the present invention is:

(13) a cooling device which includes a casing, a heat exchanger pipe with a difference in elevation in an upper and lower direction disposed in the casing, and a drain pan disposed below the heat exchanger pipe;

a bypass pipe connected between an inlet path and an outlet path of the heat exchanger pipe and to form a $CO_2$ circulation path including the heat exchanger pipe;

an on-off valve which is disposed in each of the inlet path and the outlet path of the heat exchanger pipe and which is configured to be closed at a time of defrosting so that the $CO_2$ circulation path becomes a closed circuit;

a pressure adjusting valve for adjusting pressure of the $CO_2$ refrigerant circulating in the closed circuit at the time of defrosting; and a brine circuit in which brine as a first heating medium circulates and which includes a first lead path disposed adjacent to the heat exchanger pipe in the cooling device and forming a first heat exchanger part for heating the $CO_2$ refrigerant circulating in the heat exchanger pipe, with the brine, in a lower area of the heat exchanger pipe, and a second lead path led to the drain pan; and a flow path switching unit which enables the first lead path and the second lead path to be connected in parallel or connected in series.

With the cooling unit having the configuration (13), the cooling device with the defrosting device can be easily attached to the freezer, and the power saving and low cost defrosting using the vaporization latent heat of the $CO_2$ refrigerant circulating in the closed circuit can be performed.

The cooling device can be more easily attached to the freezer when the components of the cooling unit are integrally assembled.

In some embodiments, in the configuration (13),

(14) the first lead path is formed only in the lower area of the heat exchanger pipe in the cooling device, and the first heat exchanger part is formed of an entire area of the first lead path leading into the cooling device.

In the configuration (14), the first lead path is disposed only in the lower area of the heat exchanger pipe.

Thus, the cooling unit with a simple structure that can reduce power used for the air flow forming apparatus such as a fan for forming the airflow in the cooling device can be achieved.

In some embodiments, in the configuration (13),

(15) the first lead path is provided with the difference in elevation in the cooling device and is configured in such a manner that the brine flows from a lower side to an upper side, and a flowrate adjustment valve is disposed at an intermediate position in an upper and lower direction of the first lead path.

In the configuration (15), the opening aperture of the flowrate adjustment valve is narrowed at the time of defrosting operation, whereby the second heat exchanger part can be formed in the lower area of the heat exchanger pipe.

In the configuration (15), the cooling unit with the defrosting device that can perform low power and low cost defrosting can be achieved with a simple modification to the existing cooling device with the defrosting device having the first lead path disposed across almost the entire area of the heat exchanger pipe.

In any of the configurations (13) to (15), an auxiliary electric heater can be further provided to the drain pan.

Thus, the water as a result of the melting dropped onto the drain pan can be more effectively prevented from refreezing. Furthermore, the cooling device with the defrosting device that can auxiliary heat the brine flowing in the second lead path led to the drain pan can be assembled easily.

Advantageous Effects

According to at least one embodiment of the present invention, the heat exchanger pipe disposed in the cooling device is defrosted from the inside with the $CO_2$ refrigerant, whereby reduction in initial cost and running cost required for defrosting the refrigeration apparatus and power saving can be achieved.

DETAILED DESCRIPTION

Embodiments of the present invention shown in the accompanying drawings will now be described in detail. It is intended, however, that dimensions, materials, shapes, relative positions, and the like of components described in the embodiments shall be interpreted as illustrative only and not limitative of the scope of the present invention unless otherwise specified.

For example, expressions indicating a relative or absolute arrangement such as "in a certain direction", "along a certain direction", "parallel to", "orthogonal to", "center of", "concentric to", and "coaxially" do not only strictly indicate such arrangements but also indicate a state including a tolerance or a relative displacement within an angle and a distance achieving the same function.

For example, expressions such as "the same", "equal to", and "equivalent to" indicating a state where the objects are the same, do not only strictly indicate the same state, but also indicate a state including a tolerance or a difference achieving the same function.

For example, expressions indicating shapes such as rectangular and cylindrical do not only indicate the shapes such as rectangular and cylindrical in a geometrically strict sense, but also indicate shapes including recesses/protrusions, chamfered portions, and the like, as long as the same effect can be obtained.

Expressions such as "comprising", "including", "includes", "provided with", or "having" a certain component are not exclusive expressions that exclude other components.

Figure 1:
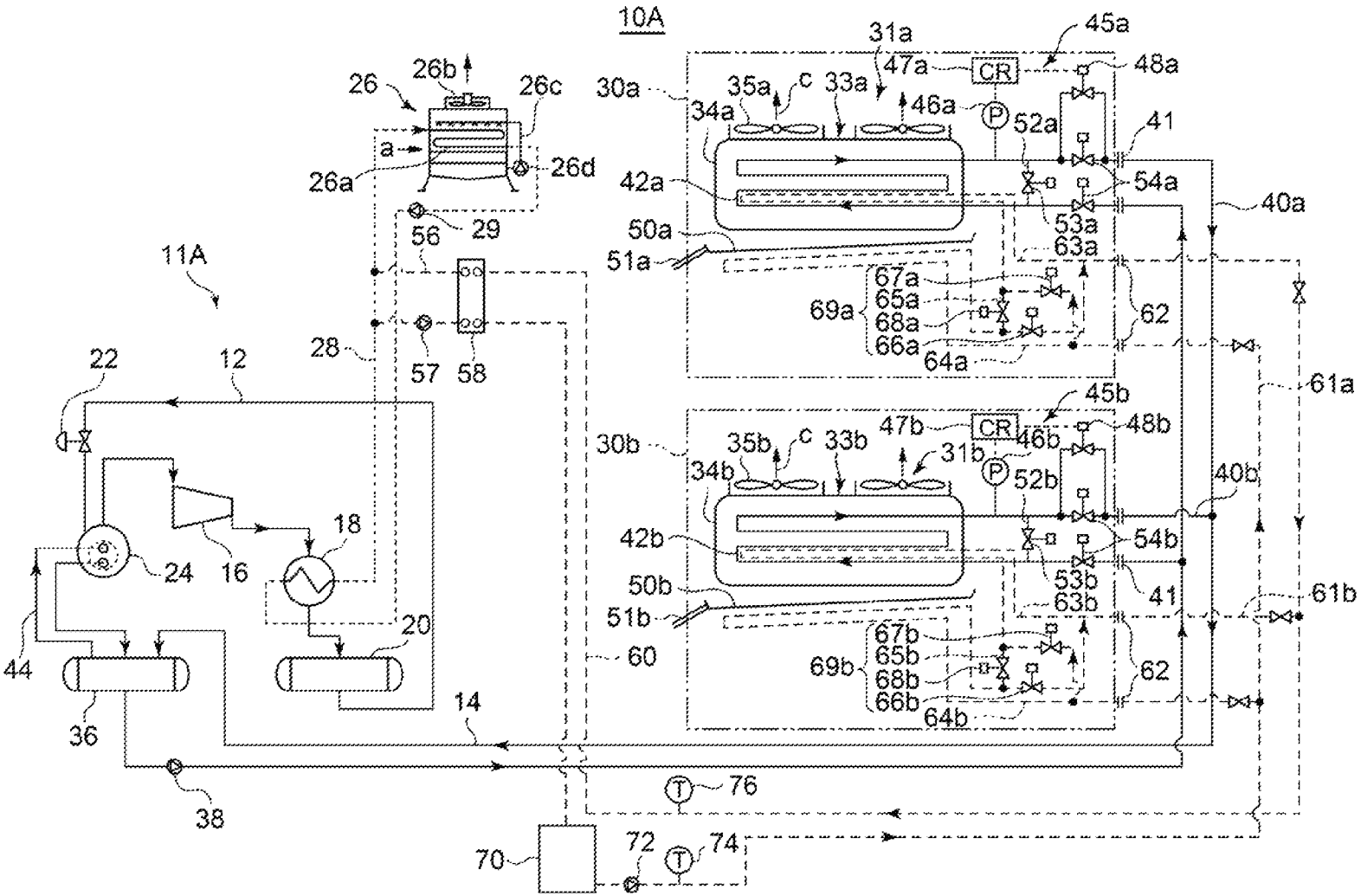
FIG. 1 is a general configuration diagram of a refrigeration apparatus according to one embodiment.
Figure 2:
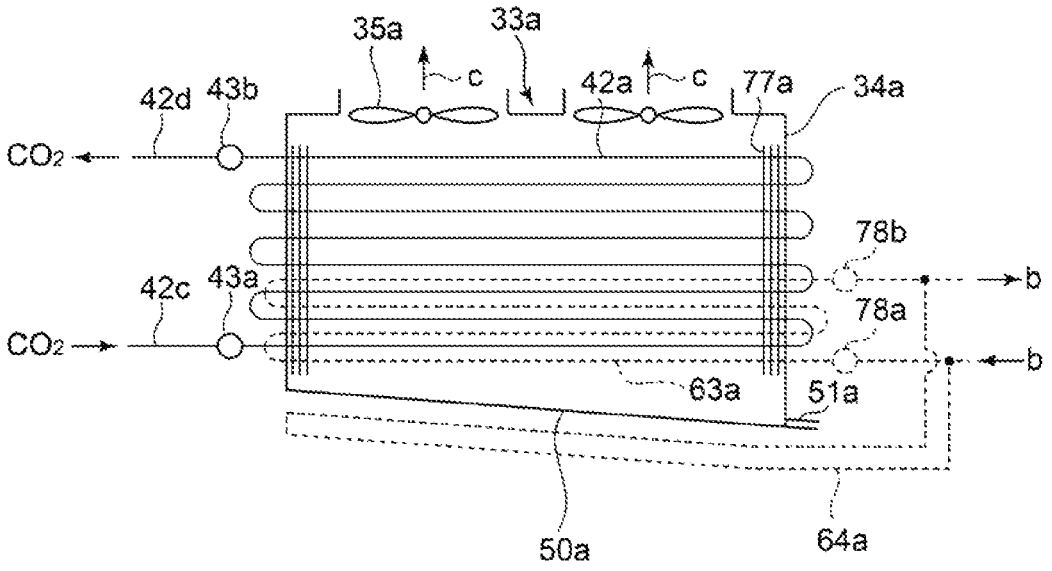
FIG. 2 is a sectional view of a cooling device in the refrigeration apparatus according to one embodiment.
Figure 3:
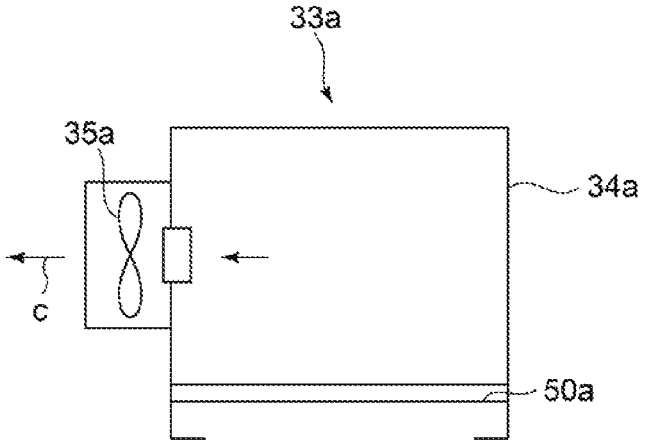
FIG. 3 is a sectional view of a cooling device in the refrigeration apparatus according to one embodiment.
Figure 4:
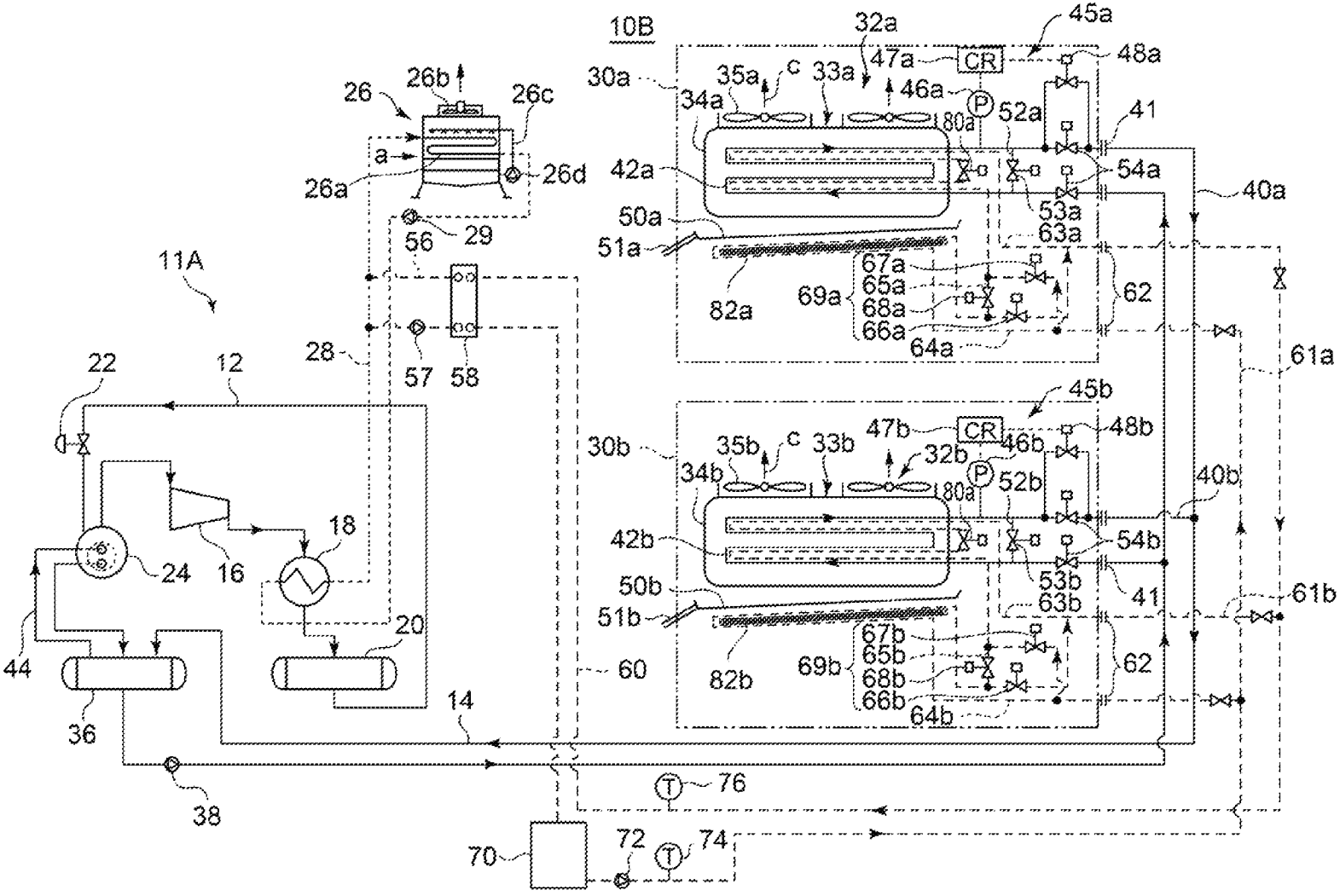
FIG. 4 is a general configuration diagram of a refrigeration apparatus according to one embodiment.
Figure 5:
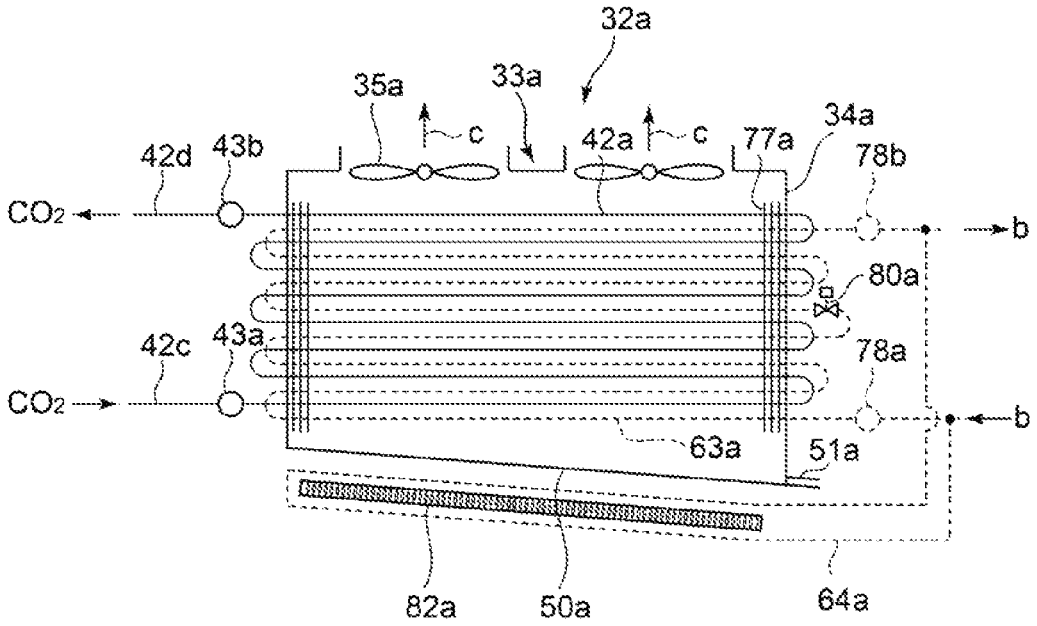
FIG. 5 is a sectional view of a cooling device in the refrigeration apparatus according to one embodiment.
Figure 6:
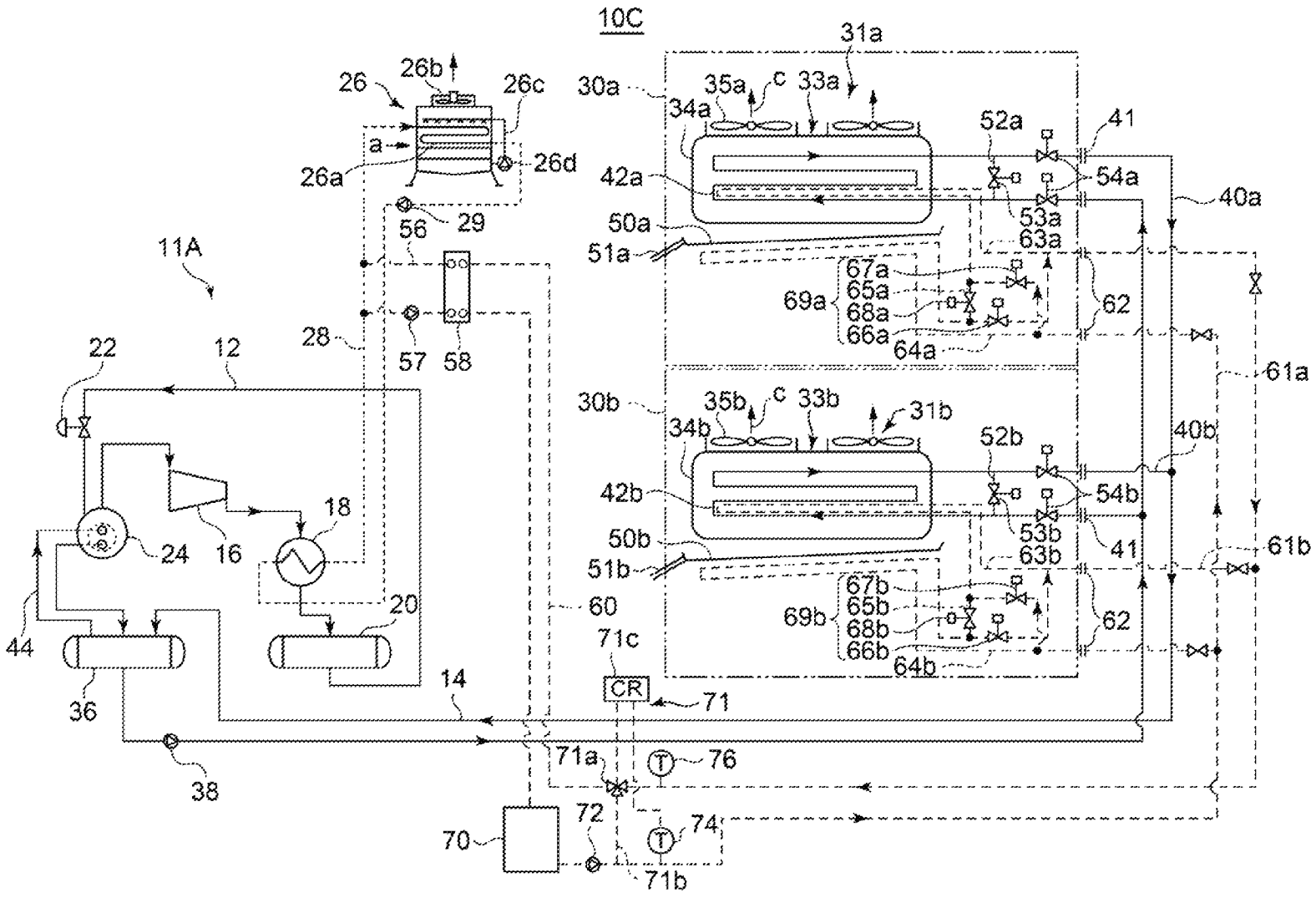
FIG. 6 is a general configuration diagram of a refrigeration apparatus according to one embodiment.
Figure 7:
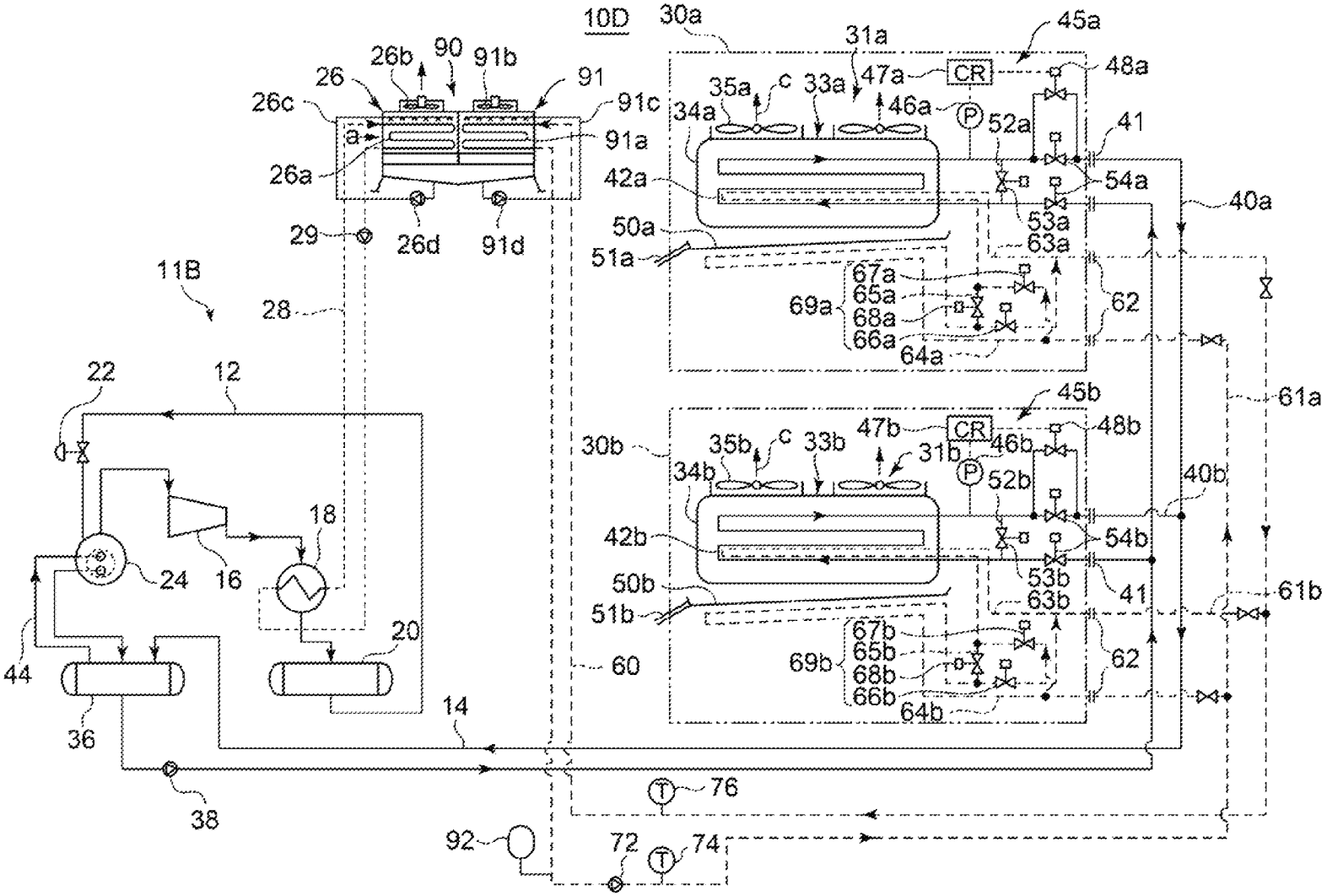
FIG. 7 is a general configuration diagram of a refrigeration apparatus according to one embodiment.

FIG. 1 to FIG. 7 show defrost systems for refrigeration apparatuses 10A to 10D according to some embodiments of the present invention. FIG. 1 and FIG. 2 show the refrigeration apparatus 10A, FIG. 4 and FIG. 5 show the refrigeration apparatus 10B, FIG. 6 shows the refrigeration apparatus 10C, and FIG. 7 shows the refrigeration apparatus 10D.

The refrigeration apparatuses 10A to 10D respectively include: cooling devices 33*a* and 33*b* respectively disposed in freezers 30*a* and 30*b*; refrigerating devices 11A and 11B which cool and liquefy $CO_2$ refrigerant; and a refrigerant circuit (corresponding to secondary refrigerant circuit 14) which permits the $CO_2$ refrigerant cooled and liquefied in the refrigerating devices to circulate to the cooling devices 33*a* and 33*b*. The cooling devices 33*a* and 33*b* respectively include: casings 34*a* and 34*b*; heat exchanger pipes 42*a* and 42*b* with a difference in elevation disposed in the casings; and drain pans 50*a* and 50*b* disposed below the heat exchanger pipes 42*a* and 42*b*.

As shown in FIG. 2, FIG. 3, and FIG. 5, in the exemplary configurations of the cooling devices 33*a* and 33*b*, an air opening is formed on the casing 34*a*, and a fan 35*a* is disposed at the opening. When the fan 35*a* operates, freezer inner air c forms an air flow flowing in and out of the casing 34*a*. The heat exchanger pipe 42*a* has a winding shape in a horizontal direction and an upper and lower direction for example. Headers 43*a* and 43*b* are disposed in an inlet tube 42*c* and an outlet tube 42*d* of the heat exchanger pipe 42*a*.

The "inlet tube 42*c*" and the "outlet tube 42*d*" are ranges of the heat exchanger pipes 42*a* and 42*b* disposed in the freezers 30*a* and 30*b*. The ranges extend from an area around partition walls of the casings 34*a* and 34*b* of the cooling devices 33*a* and 33*b* to the outer side of the casings.

In the cooling device 33*a* shown in FIG. 2 and FIG. 5, the air openings are formed on upper and side surfaces (not shown) of the casing 34*a*. The freezer inner air c flows in through the side surface and flows out through the upper surface.

In the cooling device 34*a* shown in FIG. 3, air openings are formed on both side surfaces, whereby the freezer inner air c flows in and out through both side surfaces.

The refrigerating device 11A included in the refrigeration apparatuses 10A to 10C and the refrigerating device 11B included in the refrigeration apparatus 10D include: a primary refrigerant circuit 12 in which $NH_3$ refrigerant circulates and a refrigerating cycle component is disposed; and a secondary refrigerant circuit 14 in which the $CO_2$ refrigerant circulates, the secondary refrigerant circuit extending to the cooling devices 33*a* and 33. The secondary refrigerant circuit 14 is connected to the primary refrigerant circuit 12 through a cascade condenser 24.

The refrigerating cycle component disposed in the primary refrigerant circuit 12 includes a compressor 16, a condenser 18, a liquid $NH_3$ receiver 20, an expansion valve 22, and the cascade condenser 24.

The secondary refrigerant circuit 14 includes a liquid $CO_2$ receiver 36 which stores the liquid $CO_2$ refrigerant liquefied in the cascade condenser 24 and a liquid $CO_2$ pump 38 for permitting the liquid $CO_2$ refrigerant stored in the liquid $CO_2$ receiver 36 to circulate to the heat exchanger pipes 42*a* and 42*b*.

A $CO_2$ circulation path 44 is disposed between the cascade condenser 24 and the liquid $CO_2$ receiver 36. $CO_2$ refrigerant gas introduced from the liquid $CO_2$ receiver 36 to the cascade condenser 24 through the $CO_2$ circulation path 44 is cooled and liquefied with the $NH_3$ refrigerant in the cascade condenser 24, and then returns to the liquid $CO_2$ receiver 36.

The refrigerating devices 11A and 11B use natural refrigerants such as $NH_3$ and $CO_2$ and thus facilitate an attempt to prevent the ozone layer depletion, global warming, and the like. Furthermore, the refrigerating devices 11A and 11D use $NH_3$, with high cooling performance and toxicity, as a primary refrigerant and use $CO_2$, with no toxicity or smell, as a secondary refrigerant, and thus can be used for room air conditioning and for refrigerating food products.

In the refrigeration apparatuses 10A to 10D, the secondary refrigerant circuit 14 is branched to $CO_2$ branch circuits 40*a* and 40*b* outside the freezers 30*a* and 30*b*, and the $CO_2$ branch circuits 40*a* and 40*b* are connected to the inlet tube 42*c* and the outlet tube 42*d* of the heat exchanger pipes 42*a* and 42*b* led to the outer side of the casings 34*a* and 34*b*, through a contact part 41.

Solenoid on-off valves 54*a* and 54*b* are disposed in the inlet tube 42*c* and the outlet tube 42*d* in the freezers 30*a* and 30*b*. Bypass pipes 52*a* and 52*b* are connected to the inlet tube 42*c* and the outlet tube 42*d* between the solenoid on-off valves 54*a* and 54*b* and the cooling devices 33*a* and 33*b*. Solenoid on-off valves 53*a* and 53*b* are disposed in the bypass pipes 52*a* and 52*b*. A $CO_2$ circulation path is formed of the heat exchanger pipes 42*a* and 42*b* and the bypass pipes 52*a* and 52*b*. The solenoid on-off valves 54*a* and 54*b* are closed and the solenoid on-off valves 53*a* and 53*b* are opened at the time of defrosting, whereby the $CO_2$ circulation path becomes a closed circuit.

Pressure adjusting units which adjust pressure of the $CO_2$ refrigerant circulating in the closed circuit at the time of defrosting are provided.

In the refrigeration apparatuses 10A, 10B, and 10D, the pressure adjusting units 45*a* and 45*b* respectively include: pressure adjustment valves 48*a* and 48 disposed in parallel with the solenoid on-off valves 54*a* and 54*b* in the outlet tube 42*d* of the heat exchanger pipes 42*a* and 42*b*; pressure sensors 46*a* and 46*b* disposed in the outlet tube 42*d* on the upstream side of the pressure adjustment valves 48*a* and 48*b*; and control devices 47*a* and 47*b* to which detected values of the pressure sensors 46*a* and 46*b* are input.

Control is performed in such a manner that the solenoid on-off valves 54*a* and 54*b* are opened and the solenoid on-off valves 53*a* and 53*b* are closed in a refrigerating operation and the solenoid on-off valves 54*a* and 54*b* are closed and the solenoid on-off valves 53*a* and 53*b* are opened at the time of defrosting.

Control devices 47*a* and 47*b* control valve apertures of the pressure adjustment valves 48*a* and 48*b*. Thus, the pressure of the $CO_2$ refrigerant is controlled in such a manner that condensing temperature of the $CO_2$ refrigerant circulating in the closed circuit becomes higher than a freezing point (for example, 0° C.) of water vapor in the freezer inner air c. A part of the $CO_2$ refrigerant returns to the secondary refrigerant circuit 14 through the pressure adjustment valves 48*a* and 48*b* when the pressure of the $CO_2$ refrigerant in the closed circuit exceeds set pressure. Thus, the pressure in the closed circuit is maintained at the set pressure.

In the refrigeration apparatus 10C, the pressure adjusting unit is a pressure adjusting unit 71. The pressure adjusting unit 71 includes: a three way valve 71*a* dispose on the downstream side of a temperature sensor 76 in a brine circuit (send path) 60; a bypass path 71*b* connected to the three way valve 71*a* and the brine circuit (return path) 60 on the upstream side of a temperature sensor 66; and a control device 71*c* to which a temperature of brine detected by a temperature sensor 74 is input, the control device 71*c* controlling the three way valve 71*a* in such a manner that the input value becomes equal to a set temperature. The control device 71*c* controls a temperature of the brine supplied to brine branch paths 61*a* and 61*b* is adjusted to be at a set value (for example, 10 to 15° C.).

A brine circuit 60 (shown with a dashed line) in which the brine as a heating medium circulates is branched to brine branch circuits 61*a* and 61*b* (shown with a dashed line) outside the freezers 30*a* and 30*b*. The brine branch circuits 61*a* and 61*b* are connected to brine branch circuits 63*a*, 63*b* and 64*a*, 64*b* through a contact part 62 outside the freezers 30*a* and 30*b*. The brine branch circuits 63*a* and 63*b* (shown with a dashed line) are led into the cooling devices 33*a* and 33*b*, and are disposed adjacent to the heat exchanger pipes 42*a* and 42*b* in the cooling devices. A first heat exchanger part, in which the $CO_2$ refrigerant circulating in the heat exchanger pipes 42*a* and 42*b* is heated with the brine circulating in the brine branch circuits 63*a* and 63*b*, is formed in a lower area of the heat exchanger pipes 42*a* and 42*b*.

The brine branch circuits 63*a* and 63*b* disposed in the cooling devices 33*a* and 33*b* are referred to as a "first lead path".

In the refrigeration apparatuses 10A, 10C, and 10D, the first lead path is disposed in the lower area of the heat exchanger pipes 42*a* and 42*b* in the cooling devices 33*a* and 33*b*. For example, the first lead path is disposed in the lower area at the height of ⅓ to ⅕ of the height of a disposed area of the heat exchanger pipes 42*a* and 42*b*.

In the refrigeration apparatus 10B shown in FIG. 4, the first lead path is provided with a difference in elevation in an entire area of the heat exchanger pipes 42*a* and 42*b* in the cooling devices 33*a* and 33*b* and is configured in such a manner that the brine flows from a lower side to an upper side. Flowrate adjustment valves 80*a* and 80*b* are disposed at intermediate positions of the brine branch circuits 63*a* and 63*b* in the upper and lower direction, and form a heat exchanger part in the first lead path on the upstream side (lower area) of the flowrate adjustment valves.

FIG. 2 shows a configuration of the cooling device 33*a* disposed in the refrigeration apparatuses 10A, 10C, and 10D.

The brine branch circuit 63*a* is disposed in the lower area of the heat exchanger pipe 42*a* to have a winding shape with a difference in elevation in the horizontal direction and in the upper and lower direction, as in the case of the heat exchanger pipe 42*a*, for example.

In an exemplary configuration, the drain pan 50*a* is inclined from the horizontal direction to discharge drainage, and has a drain outlet tube 51*a* formed at a lower end. The heat exchanger pipe 42*a* includes the headers 43*a* and 43*b* at an inlet and an outlet of the cooling device 33*a*.

The brine branch circuit 63*a* includes headers 78*a* and 78*b* at an inlet and an outlet of the cooling device 33*a*. The brine branch circuit 64*a* is disposed adjacent to the drain pan 50*a* and is formed to have a winding shape along a back surface of the drain pan 50*a*.

The heat exchanger pipe 42*a* and the brine branch circuit 63*a* are supported while being close to each other by a large number of plate fins 77*a* arranged in parallel.

The heat exchanger pipe 42*a* and the brine branch circuit 63*a* are inserted in a large number of holes formed on the plate fins 77*a* and thus are supported by the plate fins 77*a*. Heat transmission between the heat exchanger pipe 42*a* and the brine branch circuit 63*a* is facilitated by the plate fins 77*a*.

The cooling device 33*b* disposed in the refrigeration apparatuses 10A, 10C, and 10D has a similar configuration.

FIG. 5 shows a configuration of the cooling device 33*a* disposed in the refrigeration apparatus 10B.

The brine branch circuit 63*a* is disposed to have the winding shape across the entire heat exchanger pipe 42*a* in a height direction and the horizontal direction. The flowrate adjustment valve 80*a* is disposed at an intermediate position of the brine branch circuit 63*a* in the upper and lower direction. The cooling device 33*b* in the refrigeration apparatus 10B has a similar configuration.

The freezer inner air c cooled in the cooling device 33*a* is diffused in the freezer 32*a* by the fan 35*a*, at the time of the refrigerating operation.

A flow path switching unit 69*a* described later is omitted in FIG. 2 and FIG. 5.

The brine branch circuits 64*a* and 64*b* (shown with a dashed line) are led to the back surfaces of the drain pans 50*a* and 50*b* in the freezers 30*a* and 30*b*.

The brine branch circuits 64*a* and 64*b* led to the back surfaces of the drain pans 50*a* and 50*b* are referred to as a "second lead path".

At the time of defrosting, the drainage that has dropped onto the drain pans 50*a* and 50*b* can be prevented from refreezing with heat of the brine circulating in the brine branch circuits 64*a* and 64*b*.

The refrigeration apparatuses 10A to 10D further include flow path switching units 69*a* and 69*b* to enable the first lead path and the second lead path to be connected in parallel or in series.

The flow path switching units 69*a* and 69*b* respectively include: bypass pipes 65*a* and 65*b* connected between the brine branch circuits 63*a*, 63*b* and 64*a*, 64*b*; flowrate adjustment valves 68*a* and 68*b* disposed in the bypass pipes; and flowrate adjustment valves 66*a*, 66*b* and 67*a*, 67*b* respectively disposed in the brine branch circuits 63*a*, 63*b* and 64*a*, 64*b*.

When the brine branch circuits 63*a*, 63*b* and 64*a*, 64*b* are connected in series, the flowrate adjustment valves 68*a*, 68*b* are opened, and the flowrate adjustment valves 66*a*, 66*b* and 67*a*, 67*b* are closed.

When the brine branch circuits 63*a*, 63*b* and 64*a*, 64*b* are connected in parallel, the flowrate adjustment valves 68*a* and 68*b* are closed, and the flowrate adjustment valves 66*a*, 66*b* and 67*a*, 67*b* are opened.

In the refrigeration apparatuses 10A to 11D, the temperature sensors 74 and 76 are disposed in send and return paths of the brine circuit 60.

In the refrigeration apparatuses 10A to 10C, a receiver (open brine tank) 70 that stores the brine and a brine pump 72 are disposed in the send path of the brine circuit 60.

In the refrigeration apparatus 10D, an expansion tank 92 for offsetting pressure change and adjusting a flowrate of the brine is disposed instead of the receiver 70.

A second heat exchanger part where heat exchange between a second heating medium and the brine takes place is disposed in the refrigeration apparatuses 10A to 10D.

For example, in the refrigerating device 11A, a cooling water circuit 28 is led to the condenser 18. A cooling water branch circuit 56 including a cooling water pump 57 branches from the cooling water circuit 28 and is led to a heat exchanger part 58 corresponding to the first heat exchanger part. The brine circuit 60 is also connected to the heat exchanger part 58.

Cooling water circulating in the cooling water circuit 28 is heated with the $NH_3$ refrigerant in the condenser 18. The heated cooling water as the second heating medium heats the brine circulating in the brine circuit 60 at the time of defrosting, in the heat exchanger part 58.

For example, when a temperature of the cooling water introduced to the cooling water branch circuit 56 is 20 to 30° C., the brine can be heated up to 15 to 20° C. with the cooling water.

An aqueous solution such as ethylene glycol or propylene glycol can be used as the brine for example.

In other embodiments, for example, any heating medium other than the cooling water can be used as the heating medium. Such a heating medium includes $NH_3$ refrigerant gas with high temperature and high pressure discharged from the compressor 16, warm discharge water from a factory, a medium that has absorbed heat emitted from a boiler or potential heat of an oil cooler, and the like.

In the exemplary configuration of the refrigerating device 11, the cooling water circuit 28 is disposed between the condenser 18 and a closed-type cooling tower 26. A cooling water pump 29 makes the cooling water circulate in the cooling water circuit 28. The cooling water that has absorbed exhaust heat from the $NH_3$ refrigerant in the condenser 18 comes into contact with the outer air in the closed-type cooling tower 26 and is cooled with vaporization latent heat of water.

The closed-type cooling tower 26 includes: a cooling coil 26*a* connected to the cooling water circuit 28; a fan 26*b* that blows outer air a into the cooling coil 26*a*; and a spray pipe 26*c* and a pump 26*d* for spraying the cooling water onto the cooling coil 26*a*. The cooling water sprayed from the spray pipe 26*c* partially vaporizes. The cooling water flowing in the cooling coil 26*c* is cooled with the vaporization latent heat thus produced.

In the refrigerating device 11B shown in FIG. 7, a closed-type cooling and heating unit 90 integrating the closed-type cooling tower 26 and a closed-type heating tower 91 is provided. The closed-type cooling tower 26 in the present embodiment cools the cooling water circulating in the cooling water circuit 28 through heat exchange with spray water, and has the configuration that is the same as that of the closed-type cooling tower 26 in the embodiments described above.

In the present embodiment, the brine circuit 60 is led to the closed-type heating tower 91. The closed-type heating tower 91 receives spray water used for cooling the cooling water circulating in the cooling water circuit 28 in the closed-type cooling tower 26, and causes heat exchange between the spray water and the brine circulating in the brine circuit 60.

The closed-type heating tower 91 includes: a heating coil 91*a* connected to the brine circuit 60; and a spray pipe 91*c* and a pump 91*d* for spraying the cooling water onto the cooling coil 91*a*. An inside of the closed-type cooling tower 26 communicates with an inside of the closed-type heating tower 91 through a lower portion of a common housing.

The spray water that has absorbed the exhaust heat from the $NH_3$ refrigerant circulating in the primary refrigerant circuit 12 is sprayed onto the cooling coil 91*a* from the spray pipe 91*c*, and serves as a heating medium which heats the brine circulating in the brine circuit 60.

In the exemplary configuration of the refrigeration apparatus 10B shown in FIG. 4 and FIG. 5, an auxiliary electric heater 82*a* is disposed near the back surface of the drain pan 50*a*.

In the refrigeration apparatuses 10A, 10C, and 10D, cooling units 31*a* and 31*b* disposed in the freezers 30*a* and 30*b* are formed.

The $CO_2$ branch circuits 40*a* and 40*b* are respectively connected to the heat exchanger pipes 42*a* and 42*b* through the contact part 41 outside the freezers 30*a* and 30*b*. The brine branch circuits 61*a* and 61*b* are connected to the brine branch circuits 63*a*, 63*b* and 64*a*, 64*b* disposed in the freezers 30*a* and 30*b* through the contact part 62 outside the freezers 30*a* and 30*b*.

The cooling units 31*a* and 31*b* respectively include: the cooling devices 33*a* and 33*b*; the heat exchanger pipes 42*a* and 42*b* as well as the inlet tube 42*c* and the outlet tube 42*d* thereof; the brine branch circuits 63*a* and 63*b* disposed in the lower area of the heat exchanger pipes 42*a* and 42*b*; the brine branch circuits 64*a* and 64*b*; the flow path switching units 69*a* and 69*b*; and devices attached to these.

The components of the cooling units 31*a* and 31*b* may be integrally formed in advance.

In the refrigeration apparatus 10B shown in FIG. 3, cooling units 32*a* and 32*b* are formed. The cooling units 32*a* and 32*b* have the same components as the cooling units 31*a* and 31*b* except for the brine branch circuits 63*a* and 63*b* disposed across the entire disposed area of the heat exchanger pipes 42*a* and 42*b* in the upper and lower direction and the horizontal direction and an auxiliary electric heater 94*a* disposed on the back surfaces of the drain pans 50*a* and 50*b*.

The components of the cooling units 32*a* and 32*b* can be integrally formed in advance.

In such a configuration, the solenoid on-off valves 54*a* and 54*b* are opened and the solenoid on-off valves 53*a* and 53*b* are closed at the time of the refrigerating operation. In this state, the $CO_2$ refrigerant circulates in the $CO_2$ branch circuits 40*a* and 40*b* and in the heat exchanger pipes 42*a* and 42*b*. The fan 35*a* and a fan 35*b* form a circulation flow of the freezer inner air c passing in the cooling devices 33*a* and 33*b* inside the freezers 30*a* and 30*b*. The freezer inner air c is cooled with the $CO_2$ refrigerant circulating in the heat exchanger pipes 42*a* and 42*b*, whereby the temperature in the freezers is kept as low as −25° C., for example.

The solenoid on-off valves 54*a* and 54*b* are closed and the solenoid on-off valves 53*a* and 53*b* are opened at the time of defrosting, whereby the $CO_2$ circulation path including the heat exchanger pipes 42*a* and 42*b* and the bypass pipes 52*a* and 52*b* becomes a closed circuit. Then, warm brine, at +15° C. for example, circulates in the brine branch circuits 63*a*, 63*b* and 64*a*, 64*b*.

In the refrigeration apparatuses 10A, 10B, and 10D, the control devices 47*a* and 47*b* control opening aperture of the pressure adjustment valves 48*a* and 48*b* to raise the pressure in of the $CO_2$ refrigerant circulating in the closed circuit. Thus, the $CO_2$ refrigerant has condensing temperature (for example, +5° C./4.0 MPa) higher than the freezing point of the water vapor in the freezer inner air c.

In the refrigeration apparatus 10C, the temperature of the bring flowing into the heat exchanger pipes 42*a* and 42*b* is adjusted to the set temperature (for example, 10 to 15° C.) by the pressure adjusting unit 71. Thus, the $CO_2$ refrigerant in the closed circuit has the condensing temperature higher than the freezing point of the water vapor in the freezer inner air c.

In the refrigeration apparatuses 10A, 10C, and 10D, the $CO_2$ refrigerant is heated and vaporized with the brine in the first heat exchanger part formed in the lower area of the heat exchanger pipes 42*a* and 42*b*. The vaporized $CO_2$ refrigerant has a temperature higher than the freezing point of the water vapor in the freezer inner air in the freezers. Frost attached to outer surfaces of the heat exchanger pipes 42*a* and 42*b* in the lower area is melted by sensible heat of the vaporized $CO_2$ refrigerant. The vaporized $CO_2$ refrigerant rises to an upper area of the heat exchanger pipes 42*a* and 42*b* by a thermosiphon effect.

The $CO_2$ refrigerant that has risen melts the frost attached to the outer surfaces of the heat exchanger pipes with the condensation latent heat (219 kJ/kg under +5° C./4.0 MPa), and then the $CO_2$ refrigerant is liquefied. The liquefied $CO_2$ refrigerant falls in the heat exchanger pipes 42*a* and 42*b* with gravity and is vaporized again with the heat of the brine in the lower area.

Thus, the $CO_2$ refrigerant naturally circulates in the closed circuit by an effect of a looped thermosiphon.

The drainage of the melted frost drops onto the drain pans 50*a* and 50*b* to be discharged through the drain outlet tubes 51*a* and 51*b*. The drainage is prevented from refreezing with the sensible heat of the brine circulating in the brine branch circuits 63*a* and 63*b*. The drain pans 50*a* and 50*b* can be heated and defrosted with the sensible heat of the brine.

In the refrigeration apparatus 10B, the flowrate adjustment valves 80*a* and 80*b* are narrowed to restrict the flowrate of the brine at the time of defrosting. Thus, the heat exchanger parts in which the heat exchange between the $CO_2$ refrigerant and the brine takes place can be formed only in the area (lower area) on the upstream side of the flowrate adjustment valves 80*a* and 80*b*. Thus, the $CO_2$ refrigerant vaporizes and the attached frost melts in the upstream side area, and the vaporized $CO_2$ refrigerant rises to an area (upper area) on the downstream side of the flowrate adjustment valves 80*a* and 80*b*. The attached frost is melted by the condensation latent heat of the $CO_2$ refrigerant and the $CO_2$ refrigerant liquefies in the upstream side area.

Thus, the $CO_2$ refrigerant naturally circulates in the heat exchanger pipes 42*a* and 42*b* as the closed circuit by the thermosiphon effect, whereby the attached frost can be melted with the circulating $CO_2$ refrigerant.

The brine branch circuits 63*a*, 63*b* and 64*a*, 64*b* can be switched between the parallel connection and the serial connection with the flow path switching units 69*a* and 69*b*.

It is determined that the defrosting is completed when the difference between the detected values of the temperature sensors 74 and 76 decreases so that the temperature difference reduces to a threshold value (for example, 2 to 3° C.), and thus the defrosting operation is terminated.

According to some embodiments of the present invention, the vaporization latent heat of the $CO_2$ refrigerant is used to remove the frost attached to the heat exchanger pipes 42*a* and 42*b* from the inside through the pipe walls at the time of defrosting, whereby the amount of heat transmitted to the frost can be increased.

The heat exchange between the $CO_2$ refrigerant circulating in the closed circuit at the time of defrosting and other portions is blocked, whereby the thermal energy in the closed circuit is not emitted outside, and thus the defrosting which can achieve power saving can be performed.

The $CO_2$ refrigerant is naturally circulated by the thermosiphon effect in the closed circuit formed at the time of defrosting, whereby no pump power is required for circulating the $CO_2$ refrigerant and thus further power saving can be achieved.

With the temperature of the $CO_2$ refrigerant at the time of defrosting operation kept at a temperature closer to the freezing point of the water vapor in the freezer inner air c as much as possible, fogging can be prevented, and the pressure of the $CO_2$ refrigerant can be lowered. Thus, the pipes and the valves forming the closed circuit may be designed for lower pressure, whereby further cost reduction can be achieved.

In the configurations of the cooling device 33*a* shown in FIG. 2, FIG. 3, and FIG. 5, the heat exchanger pipes 42*a* and 42*b* and the brine branch circuits 64*a* and 64*b* are supported by a large number of plate fins 77*a*. Thus, the amount of heat transmitted between the heat exchanger pipes 42*a* and 42*b* and the brine branch circuits 63*a* and 63*b* can be increased through the heat transmission through the plate fins 77*a*.

In the refrigeration apparatuses 10A, 10C, and 10D, the brine branch circuits 63*a* and 63*b* are disposed only in the lower area of the heat exchanger pipes 42*a* and 42*b*. Thus, the pressure loss of the air flow formed by the fans 35*a* and 35*b* can be reduced, and the power used for the fans 35*a* and 35*b* can be reduced. The heat exchanger pipes 42*a* and 42*b* can be additionally disposed in a vacant space in the upper area, whereby the cooling effect with the $CO_2$ refrigerant can be increased.

In the refrigeration apparatus 10B, the brine branch circuits 63*a* and 63*b* are disposed across the entire disposed area of the heat exchanger pipes 42*a* and 42*b*. Thus, with a simple modification of providing the flowrate adjustment valves 80*a* and 80*b* to the existing cooling device, the defrosting using the vaporization latent heat of the $CO_2$ refrigerant circulating in the closed circuit that can achieve power saving and lower cost can be performed.

In the refrigeration apparatuses 10A, 10B, and 10D, the pressure adjusting units 45*a* and 45*b* are provided, whereby the pressure adjusting unit can be simplified and provided at a low cost.

In the refrigeration apparatus 10B, the pressure adjusting unit 71 is disposed. Thus, the pressure adjusting unit needs not to be provided for each cooling device, and only a single pressure adjusting unit needs to be provided. Thus, the cost reduction can be achieved, and the defrosting operation can be simplified because the pressure adjusting unit 71G can adjust the pressure in the closed circuit from the outside of the freezers 30*a* and 30*b* at the time of defrosting.

The brine branch circuits 64*a* and 64*b* are led to the back surfaces of the drain pans 50*a* and 50*b*, whereby the water as a result of the melting dropped onto the drain pans 50*a* and 50*b* can be prevented from refreezing with the sensible heat of the brine. At the same time the drain pans 50*a* and 50*b* can be heated and defrosted with the sensible heat of the brine. Thus, a heater needs not to be additionally provided to the drain pans 50*a* and 50*b* and the low cost can be achieved.

According to some embodiments, the flow path switching units 69*a* and 69*b* are provided so that the brine branch circuits 63*a*, 63*b* and 64*a*, 64*b* can be connected in parallel and in series. With the serial connection, the flowrate of the brine flowing in the brine branch circuits can be increased and a larger amount of the sensible heat can be used. With the parallel connection, the settable range of the flowrate and the temperature of the brine flowing in the circuits can be widened.

According to some embodiments, by checking the difference between the detected values of the temperature sensors 74 and 76, the timing at which the defrosting operation is terminated can be accurately determined. Thus, the excessive heating and the water vapor diffusion in the freezers can be prevented, whereby further power saving can be achieved, and the quality of the food products cooled in the freezers can be improved with a more stable freezer inner temperature.

In an embodiment including the refrigerating device 11A, the brine can be heated with the cooling water heated in the condenser 18 of the refrigerating device 11A. Thus, no heating source outside the refrigeration apparatus is required.

The temperature of the cooling water can be lowered with the brine at the time of the defrosting operation, whereby the condensing temperature of the $NH_3$ refrigerant at the time of the refrigerating operation can be lowered, and the COP of the refrigerating device can be improved.

Furthermore, in the exemplary configuration in which the cooling water circuit 28 is disposed between the condenser 18 and the cooling tower 26, the heat exchanger part 58 can be disposed in the cooling tower. Thus, the installed space for the device used for the defrosting can be downsized.

In the embodiment including the refrigerating device 11B, the closed-type cooling and heating unit 90 integrating the closed-type cooling tower 26 and the closed-type heating tower 91 is provided. Thus, the installation space for the first heat exchanger part can be downsized.

By using the closed-type heating tower 91 connected to the closed-type cooling tower 26, the heat can also be acquired from the outer air. When the refrigeration apparatus 10B employs an air cooling system, the outer air can be used as the heat source with the heating tower alone.

A plurality of the closed-type cooling towers 26, incorporated in the closed-type cooling and heating unit 90, may be laterally coupled in parallel to be installed.

With the refrigeration apparatus 10B shown in FIG. 4 and FIG. 5, the auxiliary electric heater 94*a* is provided for the drain pans 50*a* and 50*b*, whereby the heating effect of the drain pans 50*a* and 50*b* can be improved, and the dropped water as a result of the melting can be prevented from refreezing. The brine circulating in the brine branch circuits 63*a* and 63*b* led to the drain pans 50*a* and 50*b* can be additionally heated.

In the refrigeration apparatuses 10A, 10C, and 10D, the cooling units 31*a* and 31*b* are formed, whereby the cooling devices 33*a* and 33*b* as well as the defrosting device thereof can be easily attached. Furthermore, the defrosting using the vaporization latent heat of the $CO_2$ refrigerant circulating in the closed circuit that can achieve power saving and cost reduction can be achieved.

When the components of the cooling units 31*a* and 31*b* are integrally assembled, the cooling unit can be easily operated.

In the refrigeration apparatus 10B, the cooling units 32*a* and 32*b* are formed, whereby the cooling unit with the defrosting device that can perform power saving and low cost defrosting can be achieved with a simple modification to the existing cooling device with the defrosting device provided with the brine branch circuits 64*a* and 64*b* across substantially the entire area of the heat exchanger pipes 42*a* and 42*b*.

The electric heater 82*a* is provided to the cooling unit 32*a*, whereby the heating effect of the brine circulating in the drain pan 50*a* and the brine branch circuit 63*a* can be improved.

The auxiliary electric heater 82*a* is not necessarily attached to the cooling units 32*a* and 32*b*.

The embodiments may be combined as appropriate in accordance with an object and use of the refrigeration apparatus.

Figure 8:
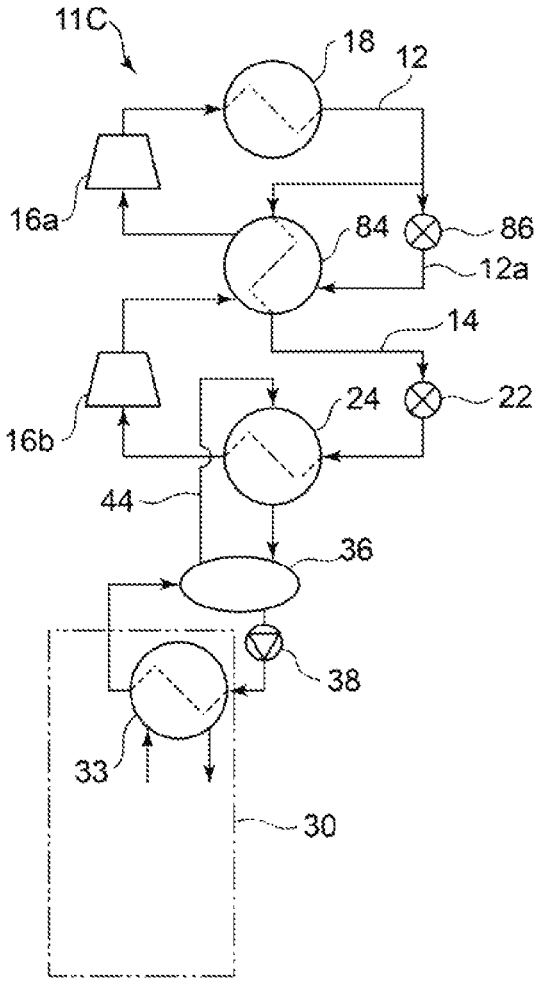
FIG. 8 is a system diagram of a refrigerating device according to one embodiment.

FIG. 8 shows another embodiment of a refrigerating device that can be applied to the present invention. In the refrigerating device 11C, a lower stage compressor 16*b* and a higher stage compressor 16*a* are disposed in the primary refrigerant circuit 12 in which the $NH_3$ refrigerant circulates. An intermediate cooling device 84 is disposed in the primary refrigerant circuit 12 and between the lower stage compressor 16*b* and the higher stage compressor 16*a*. A branch path 12*a* is branched from the primary refrigerant circuit 12 at an outlet of the condenser 18, and an intermediate expansion valve 86 is disposed in the branch path 12*a*.

The $NH_3$ refrigerant flowing in the branch path 12*a* is expanded and cooled in the intermediate expansion valve 86, and then is introduced into the intermediate cooling device 84. In the intermediate cooling device 84, the $NH_3$ refrigerant discharged from the lower stage compressor 16*b* is cooled with the $NH_3$ refrigerant introduced from the branch path 12*a*. Providing the intermediate cooling device 84 can improve the COP of the refrigerating device 11B.

The liquid $CO_2$ refrigerant, cooled and liquefied by exchanging heat with the $NH_3$ refrigerant in the cascade condenser 24, is stored in the liquid $CO_2$ receiver 36. Then, the liquid $CO_2$ pump 38 makes the liquid $CO_2$ refrigerant circulate in the cooling device 33 disposed in the freezer 30, from the liquid $CO_2$ receiver 36.

Figure 9:
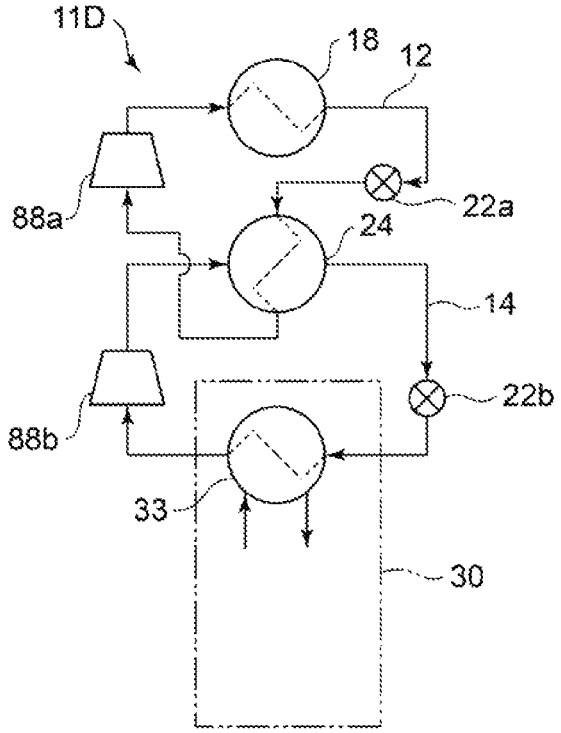
FIG. 9 is a system diagram of a refrigerating device according to one embodiment.

FIG. 9 shows another embodiment of a refrigerating device that can be applied to the present invention. The refrigerating device 11D forms a cascade refrigerating cycle. A higher temperature compressor 88*a* and an expansion valve 22*a* are disposed in the primary refrigerant circuit 12. A lower temperature compressor 88*b* and an expansion valve 22*b* are disposed in the secondary refrigerant circuit 14 connected to the primary refrigerant circuit 12 through the cascade condenser 24.

The refrigerating device 11D is a cascade refrigerating device in which a mechanical compression refrigerating cycle is formed in each of the primary refrigerant circuit 12 and the secondary refrigerant circuit 14, whereby the COP of the refrigerating device can be improved.

Figure 10:
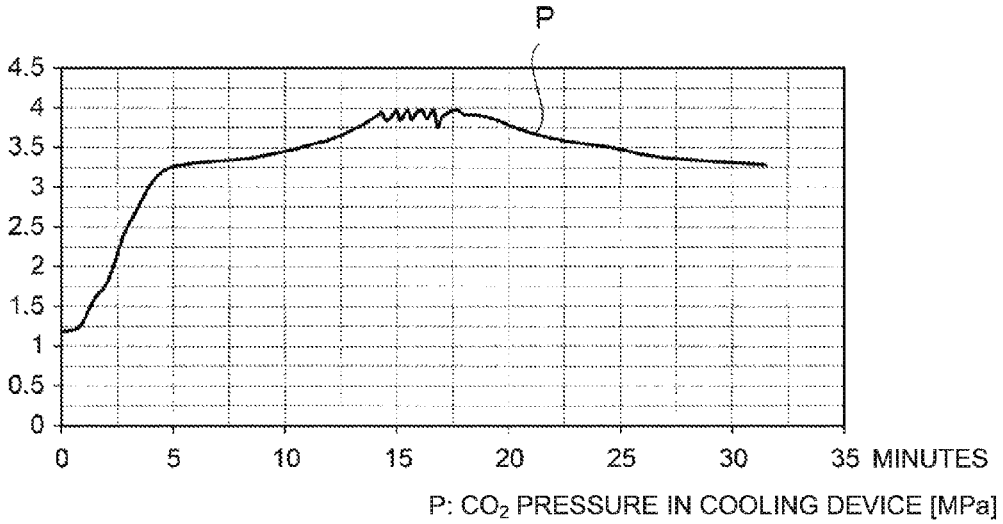
FIG. 10 is a line graph showing a result of an experiment on a refrigeration apparatus according to one embodiment.
Figure 11:
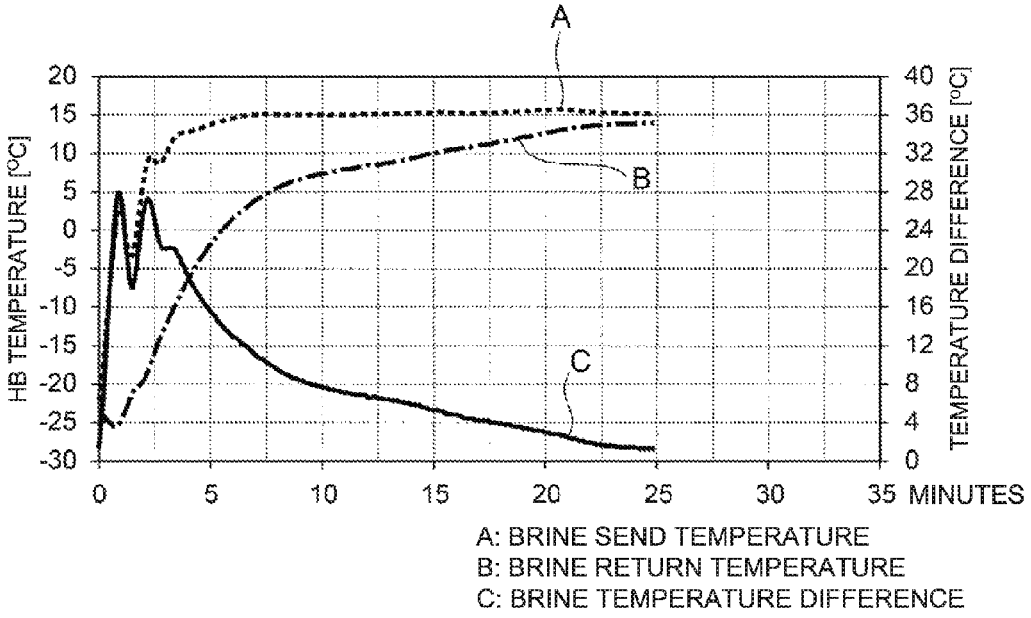
FIG. 11 is a line graph showing a result of an experiment on the refrigeration apparatus according to one embodiment.
Figure 12:
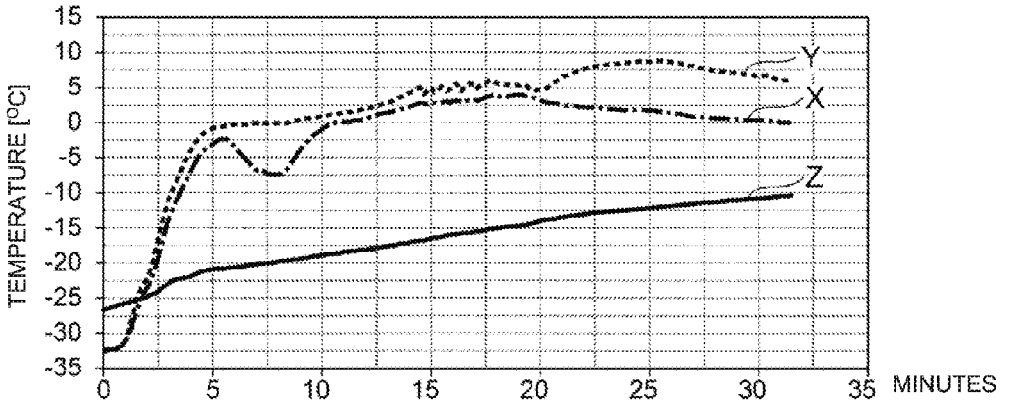
FIG. 12 is a line graph showing a result of an experiment on the refrigeration apparatus according to one embodiment.
Figure 13:
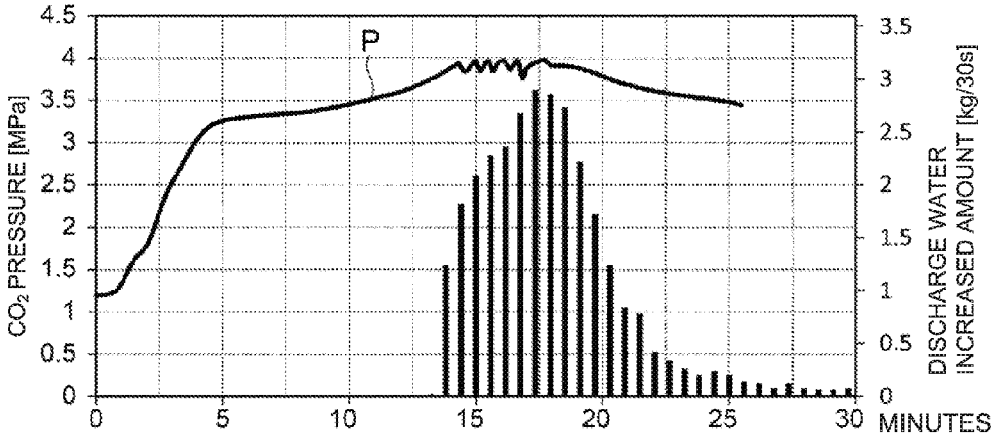
FIG. 13 is a line graph showing a result of an experiment on the refrigeration apparatus according to one embodiment.
Figure 14:
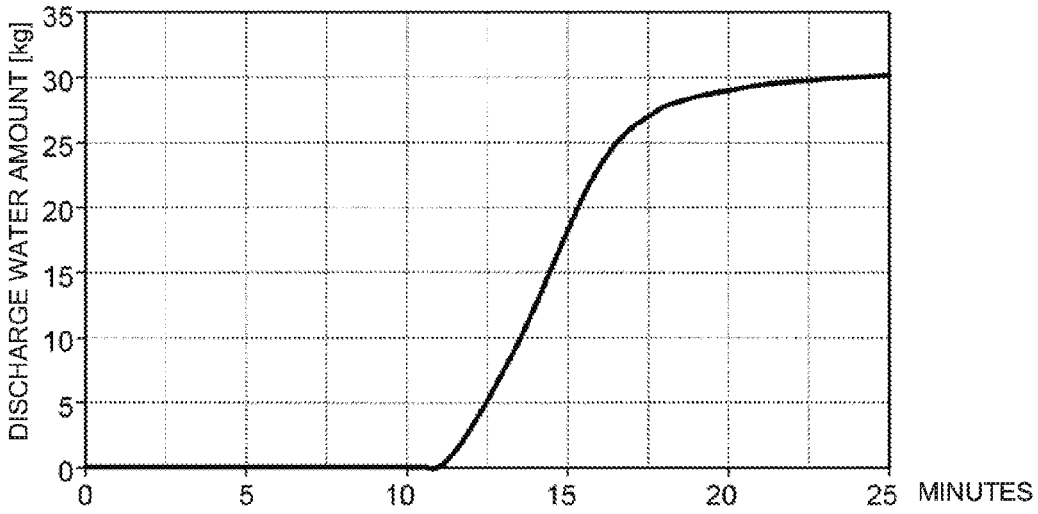
FIG. 14 is a line graph showing a result of an experiment on the refrigeration apparatus according to one embodiment.

FIG. 10 to FIG. 14 illustrate experiment data obtained by the defrosting operation performed with the temperature of the brine circulating in the brine branch circuits 63*a* and 63*b* at +15° C. and with the serial connection achieved with the flow path switching units 69*a* and 69*b*. FIG. 10 illustrates a change in pressure of the $CO_2$ refrigerant in the cooling device, and FIG. 11 illustrates a send temperature and a return temperature of the warm brine and the difference between both temperatures. FIG. 12 illustrates a change in temperature at each location. FIG. 13 shows a relationship between a change in pressure of the $CO_2$ refrigerant in the refrigerant path and an increase in discharged water. FIG. 14 illustrates a change in the amount of discharged water due to the melting of the frost.

From FIG. 10 and FIG. 12, it has been confirmed that the temperature at the header and the bend portion of the heat exchanger pipes 42*a* and 42*b* rises over 0° C. with the increase in the pressure of the $CO_2$ refrigerant in the heat exchanger pipes 42*a* and 42*b* in 10 to 15 minutes after the start of the defrosting operation.

As shown in FIG. 13 and FIG. 14, it has been confirmed that frost on the outer surfaces of the heat exchanger pipes 42*a* and 42*b* starts to melt with the increase in the pressure of the $CO_2$ refrigerant in the heat exchanger pipes 42*a* and 42*b*.

From FIG. 11, it has been found that the difference between the send temperature and the return temperature of the warm brine decreases as the defrosting operation proceeds. Thus, it has been confirmed that the timing at which the defrosting operation is completed can be recognized by detecting the difference.

INDUSTRIAL APPLICABILITY

According to the present invention, reduction in initial and running costs required for defrosting a cooling device disposed in a cooling space such as a freezer and power saving can be achieved in a refrigeration apparatus using $CO_2$ refrigerant.

REFERENCE SIGNS LIST

10A, 10B, 10C, 10D refrigeration apparatus
11A, 11B, 11C, 11D refrigerating device
12 primary refrigerant circuit
14 secondary refrigerant circuit
16 compressor
16*a* higher stage compressor
16*b* lower stage compressor
18 condenser
20 liquid $NH_3$ receiver
22, 22*a*, 22*b* expansion valve
24 cascade condenser
26 closed-type cooling tower
28 cooling water circuit
29, 57 cooling water pump
30, 30*a*, 30*b* freezer
31*a*, 31*b*, 32*a*, 32*b* cooling unit
33, 33*a*, 33*b* cooling device
34*a*, 34*b* casing
35*a*, 35*b* fan
36 liquid $CO_2$ receiver
38 liquid $CO_2$ pump
40*a*, 40*b* $CO_2$ branch circuit
41, 62 contact part
42*a*, 42*b* heat exchanger pipe
42*c* inlet tube
42*d* outlet tube
43*a*, 43*b*, 78*a*, 78*b* header
44 $CO_2$ circulation path
45*a*, 45*b*, 71 pressure adjusting unit
46*a*, 46*b* pressure sensor
47*a*, 47*b*, 71*c* control device
48*a*, 48*b* pressure adjustment valve
50*a*, 50*b* drain pan
51*a*, 51*b* drain outlet tube
52*a*, 52*b*, 65*a*, 65*b* bypass pipe
53*a*, 53*b*, 54*a*, 54*b* solenoid on-off valve
56 cooling water branch circuit
58 heat exchanger
60 brine circuit
61*a*, 61*b*, 63*a*, 63*b*, 64*a*, 64*b* brine branch circuit
66*a*, 66*b*, 67*a*, 67*b*, 68*a*, 68*b*, 80*a*, 80*b* flowrate adjustment valve
69*a*, 69*b* flow path switching unit
70 receiver
72 brine pump
74, 76 temperature sensor
82*a*, 82*b* auxiliary electric heater
84 intermediate cooling device
86 intermediate expansion valve
88*a* higher temperature compressor
88*b* lower temperature compressor
90 closed-type cooling and heating unit
91 closed-type heating tower
92 expansion tank
a outer air
b brine
c freezer inner air

The invention claimed is:

1. A defrost system for a refrigeration apparatus including: a cooling device which is disposed in a freezer, and includes a casing, a heat exchanger pipe with a difference in elevation disposed in the casing, and a drain receiver unit disposed below the heat exchanger pipe; a refrigerating device configured to cool and liquefy $CO_2$ refrigerant; and a refrigerant circuit for permitting the $CO_2$ refrigerant cooled and liquefied in the refrigerating device to circulate to the heat exchanger pipe, the defrost system comprising:

a bypass pipe connected between an inlet path and an outlet path of the heat exchanger pipe to form a $CO_2$ circulation path including the heat exchanger pipe;

an on-off valve disposed in each of the inlet path and the outlet path of the heat exchanger pipe and configured to be-closed at a time of defrosting so that the $CO_2$ circulation path becomes a closed circuit;

a pressure adjusting unit for adjusting pressure of the $CO_2$ refrigerant circulating in the closed circuit at the time of defrosting; and a brine circuit in which brine as a first heating medium circulates and which includes a first lead path disposed adjacent to the heat exchanger pipe in the cooling device and forming a first heat exchanger part for heating the $CO_2$ refrigerant circulating in the heat exchanger pipe, with the brine, in a lower area of the heat exchanger pipe, wherein the defrost system configured to permitting the $CO_2$ refrigerant to naturally circulate in the closed circuit at the time of defrosting by a thermosiphon effect.

2. The defrost system for the refrigeration apparatus according to claim 1, wherein the first lead path is formed only in the lower area of the heat exchanger pipe in the cooling device, and the first heat exchanger is formed of an entire area of the first lead path-led into the cooling device.

3. The defrost system for the refrigeration apparatus according to claim 1, wherein the first lead path is provided with the difference in elevation in the cooling device and is configured in such a manner that the brine flows from a lower side to an upper side, and a flowrate adjustment valve is disposed at an intermediate position in an upper and lower direction of the first lead path, and the first heat exchanger part is formed at a portion of the first lead path on an upstream side of the flowrate adjustment valve.

4. The defrost system for the refrigeration apparatus according to claim 1, wherein the pressure adjusting unit comprises a pressure adjustment valve disposed in the outlet path of the heat exchanger pipe.

5. The defrost system for the refrigeration apparatus according to claim 1, wherein the pressure adjusting unit is configured to adjusts a temperature of the brine flowing into the first heat exchanger part to adjust the pressure of the $CO_2$ refrigerant circulating in the closed circuit.

6. The defrost system for the refrigeration apparatus according to claim 1, wherein the brine circuit includes a second lead path led to the drain receiver unit.

7. The defrost system for the refrigeration apparatus according to claim 6, further comprising a flow path switching unit which enables the first lead path and the second lead path to be connected in parallel or connected in series.

8. The sublimation defrost system for the refrigeration apparatus according to claim 1, further comprising a first temperature sensor and a second temperature sensor which are respectively disposed at an inlet and an outlet of the brine circuit and detect a temperature of the brine flowing through the inlet and the outlet.

9. The defrost system for the refrigeration apparatus according to claim 1, wherein the refrigerating device includes:

a primary refrigerant circuit in which $NH_3$ refrigerant circulates and a refrigerating cycle component is disposed;

a secondary refrigerant circuit in which the $CO_2$ refrigerant circulates, the secondary refrigerant circuit led to the cooling device, the secondary refrigerant circuit being connected to the primary refrigerant circuit through a cascade condenser; and a liquid $CO_2$ receiver for storing the $CO_2$ refrigerant liquefied in the cascade condenser and a liquid $CO_2$ pump for sending the $CO_2$ refrigerant stored in the liquid $CO_2$ receiver to the cooling device, which are disposed in the secondary refrigerant circuit.

10. The defrost system for the refrigeration apparatus according to claim 1, wherein the refrigerating device is a $NH_3/CO_2$ cascade refrigerating device including:

a primary refrigerant circuit in which $NH_3$ refrigerant circulates and a refrigerating cycle component is disposed; and a secondary refrigerant circuit in which the $CO_2$ refrigerant circulates and a refrigerating cycle component is disposed, the secondary refrigerant circuit led to the cooling device, the secondary refrigerant circuit being connected to the primary refrigerant circuit through a cascade condenser.

11. The defrost system for the refrigeration apparatus according to claim 9, further comprising a cooling water circuit led to a condenser provided as a part of the refrigerating cycle component disposed in the primary refrigerant circuit, wherein a second heating medium is cooling water circulating in the cooling water circuit and heated in the condenser, and the second heat exchanger part includes a heat exchanger to which the cooling water circuit and the brine circuit are led, the heat exchanger exchanging heat between the cooling water circulating in the cooling water circuit and heated in the condenser and the brine circulating in the brine circuit.

12. The defrost system for the refrigeration apparatus according to claim 9, further comprising a cooling water circuit led to a condenser provided as a part of the refrigerating cycle component disposed in the primary refrigerant circuit, wherein the second heating medium is cooling water circulating in the cooling water circuit and heated in the condenser, and the second heat exchanger part includes:

a cooling tower for cooling the cooling water circulating in the cooling water circuit by exchanging heat between the cooling water and spray water; and a heating tower for receiving the spray water and exchanging heat between the brine circulating in the brine circuit and the spray water.

13. A cooling unit comprising:

a cooling device which includes a casing, a heat exchanger pipe with a difference in elevation in an upper and lower direction disposed in the casing, and a drain pan disposed below the heat exchanger pipe;

a bypass pipe connected between an inlet path and an outlet path of the heat exchanger pipe and to form a $CO_2$ circulation path including the heat exchanger pipe;

an on-off valve which is disposed in each of the inlet path and the outlet path of the heat exchanger pipe and which is configured to be closed at a time of defrosting so that the $CO_2$ circulation path becomes a closed circuit;

a pressure adjusting valve for adjusting pressure of the $CO_2$ refrigerant circulating in the closed circuit at the time of defrosting; and a brine circuit in which brine as a first heating medium circulates and which includes a first lead path disposed adjacent to the heat exchanger pipe in the cooling device- and forming a first heat exchanger part for heating the $CO_2$ refrigerant circulating in the heat exchanger pipe, with the brine, in a lower area of the heat exchanger pipe, and a second lead path led to the drain pan; and a flow path switching unit which enables the first lead path and the second lead path to be connected in parallel or connected in series.

14. The cooling unit according to claim 13, wherein the first lead path is formed only in the lower area of the heat exchanger pipe in the cooling device, and the first heat exchanger is formed of an entire area of the first lead path leading into the cooling device.

15. The cooling unit according to claim 13, wherein the first lead path is provided with the difference in elevation in the cooling device and is configured in such a manner that the brine flows from a lower side to an upper side, and a flowrate adjustment valve is disposed at an intermediate position in an upper and lower direction of the first lead path.

* * * * *